US009199453B2

(12) United States Patent
Ono et al.

(10) Patent No.: US 9,199,453 B2
(45) Date of Patent: Dec. 1, 2015

(54) DRIVING DEVICE AND DRIVING METHOD OF INKJET HEAD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Shunichi Ono, Shizuoka-ken (JP); Teruyuki Hiyoshi, Shizuoka-ken (JP); Mamoru Kimura; Tomohisa Yoshimaru, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/100,230

(22) Filed: Dec. 9, 2013

(65) Prior Publication Data

US 2014/0160194 A1 Jun. 12, 2014

(30) Foreign Application Priority Data

Dec. 11, 2012 (JP) ..... 2012-270625

(51) Int. Cl.
*B41J 2/38* (2006.01)
*B41J 2/045* (2006.01)

(52) U.S. Cl.
CPC ..... *B41J 2/04581* (2013.01); *B41J 2/04541* (2013.01); *B41J 2/04596* (2013.01); *B41J 2202/10* (2013.01)

(58) Field of Classification Search
CPC ..... B41J 2/04581; B41J 2/04588; B41J 2/04541; B41J 2/14209; B41J 2/14217; B41J 2/14225
USPC ..... 347/10
See application file for complete search history.

(56) References Cited

U.S. PATENT DOCUMENTS

| | | | | |
|---|---|---|---|---|
| 6,437,964 | B1 | 8/2002 | Takamura et al. | |
| 6,733,113 | B2 * | 5/2004 | Yoshizawa et al. | 347/68 |
| 6,841,920 | B2 | 1/2005 | Takamura et al. | |
| 2014/0160195 | A1 * | 6/2014 | Ono et al. | 347/10 |
| 2014/0176627 | A1 * | 6/2014 | Ono et al. | 347/10 |

FOREIGN PATENT DOCUMENTS

| | | |
|---|---|---|
| JP | 09-254412 | 9/1997 |

* cited by examiner

*Primary Examiner* — Jannelle M Lebron
*Assistant Examiner* — Jeremy Bishop
(74) *Attorney, Agent, or Firm* — Amin, Turocy & Watson, LLP

(57) ABSTRACT

There is provided a controller which sets electrodes which are respectively disposed on wall surfaces of a plurality of ink chambers which are arranged in parallel so as to be separated from each other by partitions made of a piezoelectric material, to a high impedance state. In addition, at a timing when an identical potential is applied to the electrodes of at least three ink chambers which are arranged in parallel so as to be separated from each other by mutually adjacent partitions, the controller sets electrodes of ink chambers other than ink chambers located on both sides to a high impedance state.

4 Claims, 17 Drawing Sheets

500

| Hi-Z DES-IGNATION | POTENTIAL CODE | G | PV | MV | LV CON | No.x |
|---|---|---|---|---|---|---|
| 0 | 00 | 1 | 0 | 0 | 0 | VSS |
| 0 | 01 | 0 | 1 | 0 | 0 | +VAA |
| 0 | 10 | 0 | 0 | 1 | 0 | -VAA |
| 0 | 11 | 0 | 0 | 0 | 1 | LVCON |
| 1 | — | 0 | 0 | 0 | 0 | Hi-Z |

DRIVING DEVICE AND DRIVING METHOD OF INKJET HEAD

CROSS-REFERENCE TO RELATED APPLICATION

This application is based upon and claims the benefit of priority from Japanese Patent Application No. 2012-270625, filed Dec. 11, 2012, the entire contents of which are incorporated herein by reference.

FIELD

Embodiments described herein relate generally to a driving device and a driving method of an inkjet head in which adjacent ink chambers share an actuator.

BACKGROUND

There is a type of inkjet head in which adjacent ink chambers share an actuator. This inkjet head is called a share mode type. In this type of inkjet head, a plurality of ink chambers which are arranged in parallel are divided into (n+1) sets at intervals of n (where n is 2 or more). A driving device changes a phase for driving each set and selectively drives each ink chamber in the same set. When the ink chamber is driven, ink droplets are ejected from a nozzle which communicates with the ink chamber.

An ink chamber B which is adjacent to a driven ink chamber A is not driven. However, in the ink chamber B, a partition on one side which separates the ink chamber A therefrom is deformed. At this time, if a partition on the opposite side is also deformed, there is a probability that ink droplets may be erroneously ejected from a nozzle which communicates with the ink chamber B. For this reason, the driving device simultaneously drives an ink chamber C which shares the partition on the opposite side as an actuator, at the same potential as a potential of the ink chamber B so that the partition on the opposite side of the ink chamber B is not deformed. In addition, if the ink chamber A is driven but does not eject ink, the ink chamber A is required to be simultaneously driven at the same potential as potentials of the ink chambers B adjacent to both sides thereof so that the partitions of both ends of the ink chamber A are not deformed. For this reason, if no ink chambers A eject ink, a phenomenon may occur in which all the ink chambers are simultaneously driven at the same potential.

In the share mode type inkjet head, a plurality of ink chambers which are separated from each other by partitions made of a piezoelectric material are arranged in parallel. An electrode is disposed on wall surfaces of each ink chamber. Therefore, the inkjet head is equivalent to a series circuit of capacitors from the electrical viewpoint. Floating capacitors occur between the capacitors which are connected in series in this circuit. The floating capacitors are charged or discharged when voltages with the same potential are simultaneously applied to both ends thereof in a state in which the capacitor is interposed therebetween. Noise current is generated in the head due to the charge or discharge of the floating capacitors, and thus power is wastefully consumed.

DETAILED DESCRIPTION

An object of the exemplary embodiments is to provide a driving device and a driving method of an inkjet head capable of reducing noise current or wasteful power consumption caused by floating capacitors.

In a driving device of an inkjet head in which electrodes are respectively disposed on wall surfaces of a plurality of ink chambers which are arranged in parallel so as to be separated from each other by partitions made of a piezoelectric material, a potential difference is given to the electrodes of two adjacent ink chambers so as to deform the partitions interposed between the electrodes, and ink is ejected from a nozzle which communicates with the ink chamber having the deformed partitions as wall surfaces, and the device includes a controller that sets the electrodes to a high impedance state. In addition, at a timing when an identical potential is applied to the electrodes of at least three ink chambers which are arranged in parallel so as to be separated from each other by mutually adjacent partitions, the controller sets electrodes of ink chambers other than ink chambers located on both sides to a high impedance state.

Further, a driving method of the inkjet head includes setting electrodes of ink chambers other than ink chambers located on both sides to a high impedance state at a timing when an identical potential is applied to the electrodes of at least the three ink chambers which are arranged in parallel so as to be separated from each other by the mutually adjacent partitions.

Hereinafter, exemplary embodiments of a driving device and a driving method of an inkjet head will be described with reference to the drawings.

In addition, these exemplary embodiments employ a share mode type line inkjet head 100.

First Exemplary Embodiment

Figure 1:
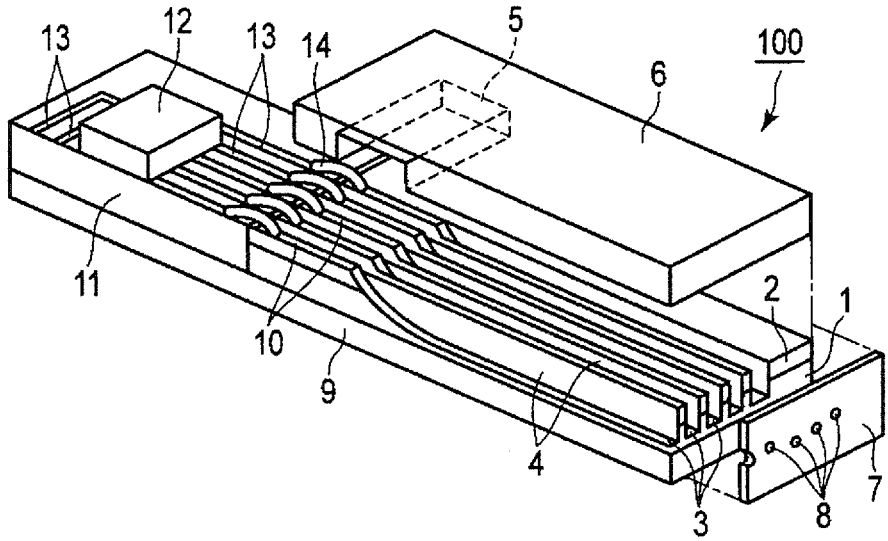
FIG. 1 is a partially exploded perspective view of a line inkjet head.
Figure 2:
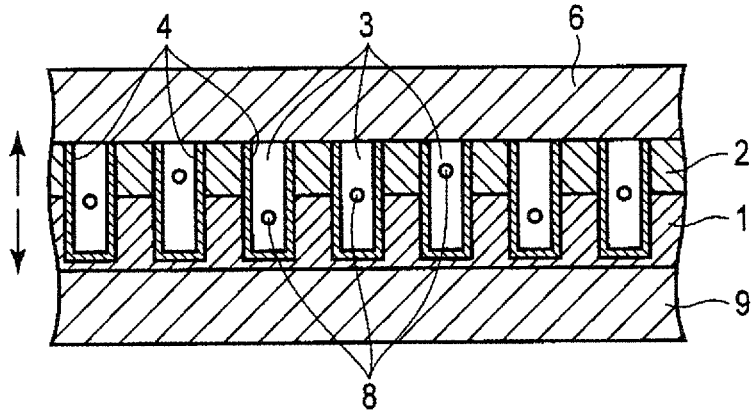
FIG. 2 is a transverse cross-sectional view in a front part.
Figure 3:
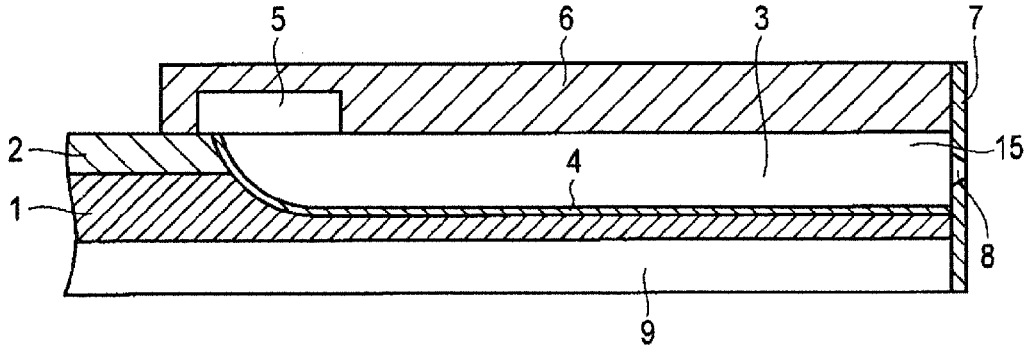
FIG. 3 is a longitudinal cross-sectional view in the front part.

First, a configuration of a line inkjet head 100 (hereinafter, simply referred to as a head 100) will be described with reference to FIGS. 1 to 3. FIG. 1 is a partially exploded perspective view of the head 100, FIG. 2 is a transverse cross-sectional view in a front part of the head 100, and FIG. 3 is a longitudinal cross-sectional view in the front part of the head 100.

The head 100 includes a base substrate 9. In addition, a first piezoelectric member 1 is joined to an upper surface on a front side of the base substrate 9, and a second piezoelectric member 2 is joined onto the first piezoelectric member 1. The first piezoelectric member 1 and the second piezoelectric member 2 are joined together so as to be polarized in opposite directions to each other as indicated by the arrows of FIG. 2 in the plate thickness direction. Further, a plurality of long grooves 3 extending from the front end side of the joined piezoelectric members 1 and 2 to the rear end side are disposed. The respective grooves 3 have a constant interval and are parallel to each other. Each groove 3 has an open front end and a rear end tilted upward.

An electrode 4 is provided on a side wall and a bottom of each groove 3. Further, an extraction electrode 10 extends from the electrode 4 toward an upper surface of the rear part of the second piezoelectric member 2 from the rear end of each groove 3.

The upper parts of the respective grooves 3 are covered by a top plate 6. The top plate 6 includes a common ink chamber 5 on the inner rear side thereof.

The front ends of the respective grooves 3 are covered by an orifice plate 7. An ink chamber 15 which stores ink is formed by the top plate 6 and each groove 3 surrounded by the orifice plate 7. The ink chamber 15 is also referred to as a pressure chamber. A nozzle 8 is formed at a position opposed to each groove 3 of the orifice plate 7. Each nozzle 8 communicates with the opposed groove 3, that is, the ink chamber 15.

A printed board 11 on which a conductive pattern 13 is formed is joined to the upper surface on the rear side of the base substrate 9. In addition, a drive IC 12 including a head driving unit which is a driver is mounted on the printed board 11. The drive IC 12 is connected to the conductive pattern 13. The conductive pattern 13 is coupled to each extraction electrode 10 via a lead 14 in a wire bonding manner.

Next, a description will be made of an operation principle of the head 100 with the above-described configuration with reference to FIGS. 4A to 4C.

Figure 4A:
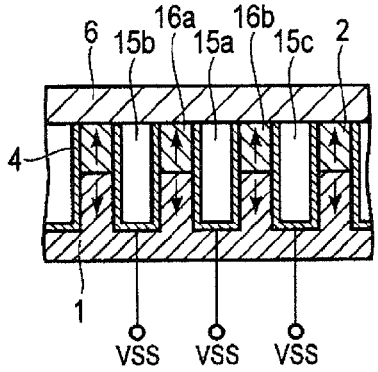
FIGS. 4A to 4C are diagrams used to describe an operation principle of the line inkjet head.

FIG. 4A illustrates a state in which the electrodes 4 which are respectively disposed on wall surfaces of a central ink chamber 15*a* and both ink chambers 15*b* and 15*c* adjacent to the ink chamber 15*a* all have a ground voltage VSS. In this state, a partition 16*a* interposed between the ink chamber 15*a* and the ink chamber 15*b* and a partition 16*b* interposed between the ink chamber 15*a* and the ink chamber 15*c*, do not receive any distortion operation.

Figure 4B:
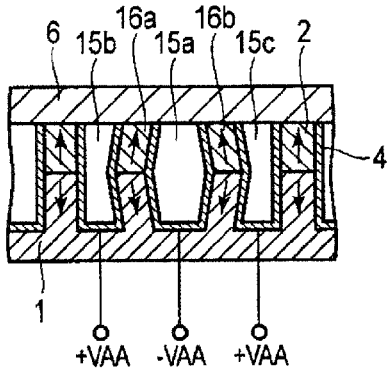

FIG. 4B illustrates a state in which a negative voltage −VAA is applied to the electrode 4 of the central ink chamber 15*a*, and the positive voltage +VAA is applied to the electrodes 4 of both the adjacent ink chambers 15*b* and 15*c*. In this state, an electric field is applied to the respective partitions 16*a* and 16*b* in a direction perpendicular to a polarization direction of the piezoelectric members 1 and 2. Due to this application, the respective partitions 16*a* and 16*b* are deformed outward so as to increase a volume of the ink chamber 15*a*.

Figure 4C:
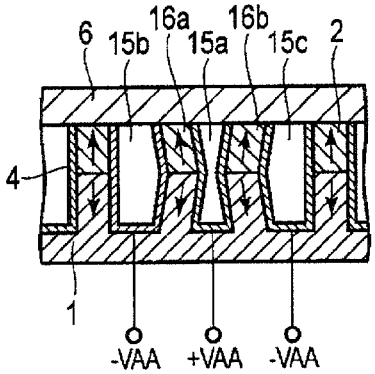

FIG. 4C illustrates a state in which the positive voltage +VAA is applied to the electrode 4 of the central ink chamber 15*a*, and the negative voltage −VAA is applied to the electrodes 4 of both the adjacent ink chambers 15*b* and 15*c*. In this state, an electric field is applied to the respective partitions 16*a* and 16*b* in an opposite direction to the case of FIG. 4B. Due to this application, the respective partitions 16*a* and 16*b* are deformed inward so as to decrease a volume of the ink chamber 15*a*.

If a volume of the ink chamber 15*a* is increased or decreased, pressure vibration occurs in the ink chamber 15*a*. Due to this pressure vibration, a pressure in the ink chamber 15*a* increases, and thus ink droplets are ejected from the nozzle 8 which communicates with the ink chamber 15*a*.

As above, the partitions 16*a* and 16*b* which separate the respective ink chambers 15*a*, 15*b* and 15*c* from each other are actuators for giving pressure vibration to the inside of the ink chamber 15*a* which has the partitions 16*a* and 16*b* as wall surfaces. Therefore, each ink chamber 15 shares the actuator with the respectively adjacent ink chambers 15. For this reason, the driving device of the head 100 cannot drive each ink chamber 15 individually. The driving device divides the respective ink chambers 15 into (n+1) groups at intervals of n (where n is an integer of 2 or more) for driving. In the present exemplary embodiment, so-called three-division driving is exemplified in which the driving device divides the respective ink chambers 15 into three sets at intervals of two for driving. In addition, the three-division driving is only an example, and four-division driving, five-division driving, and the like may be employed.

Figure 5:
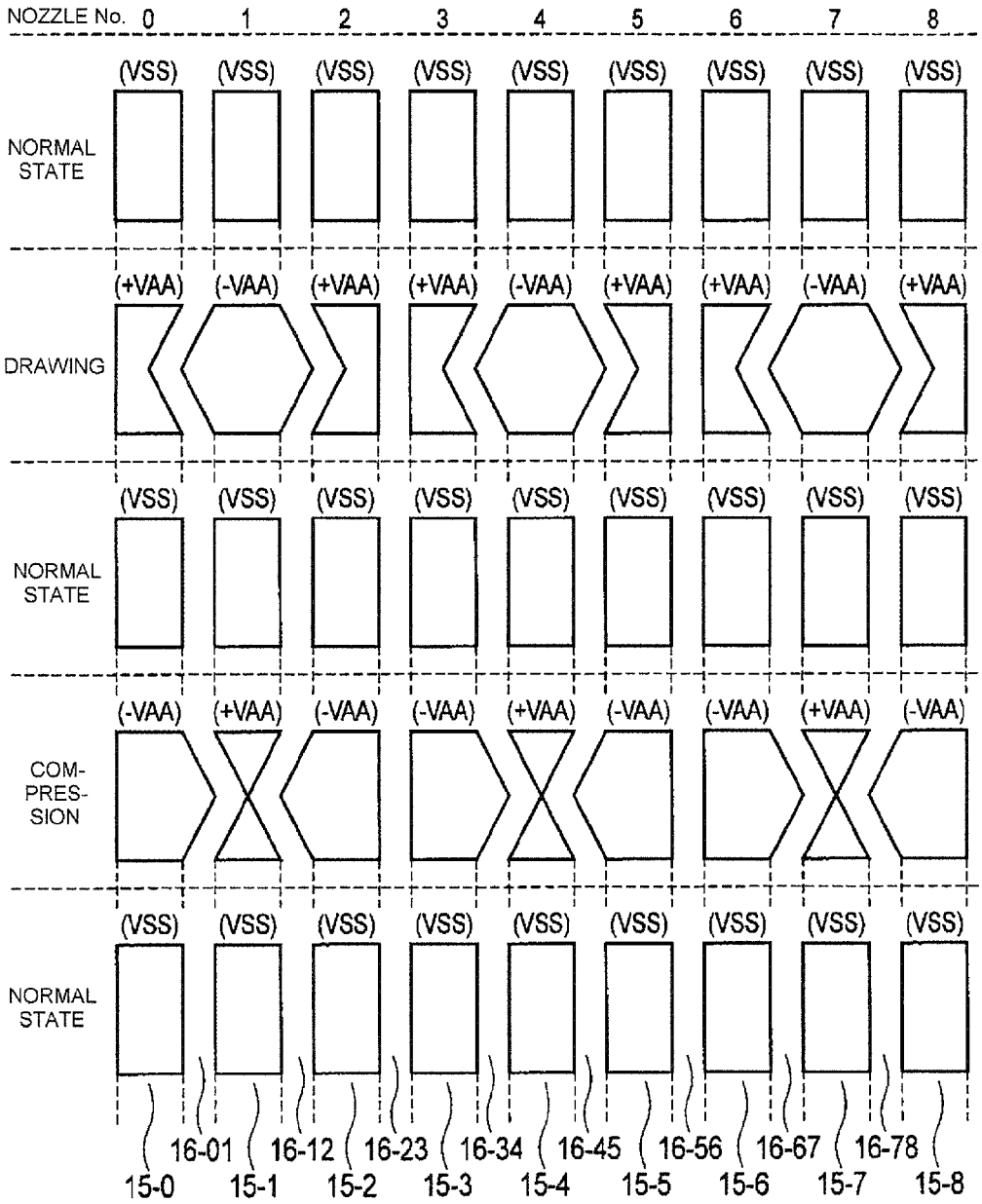
FIG. 5 is a schematic diagram illustrating an example of a relationship between an ink chamber state and a driving pulse voltage when the line inkjet head is driven in a three-division manner.
Figure 6:
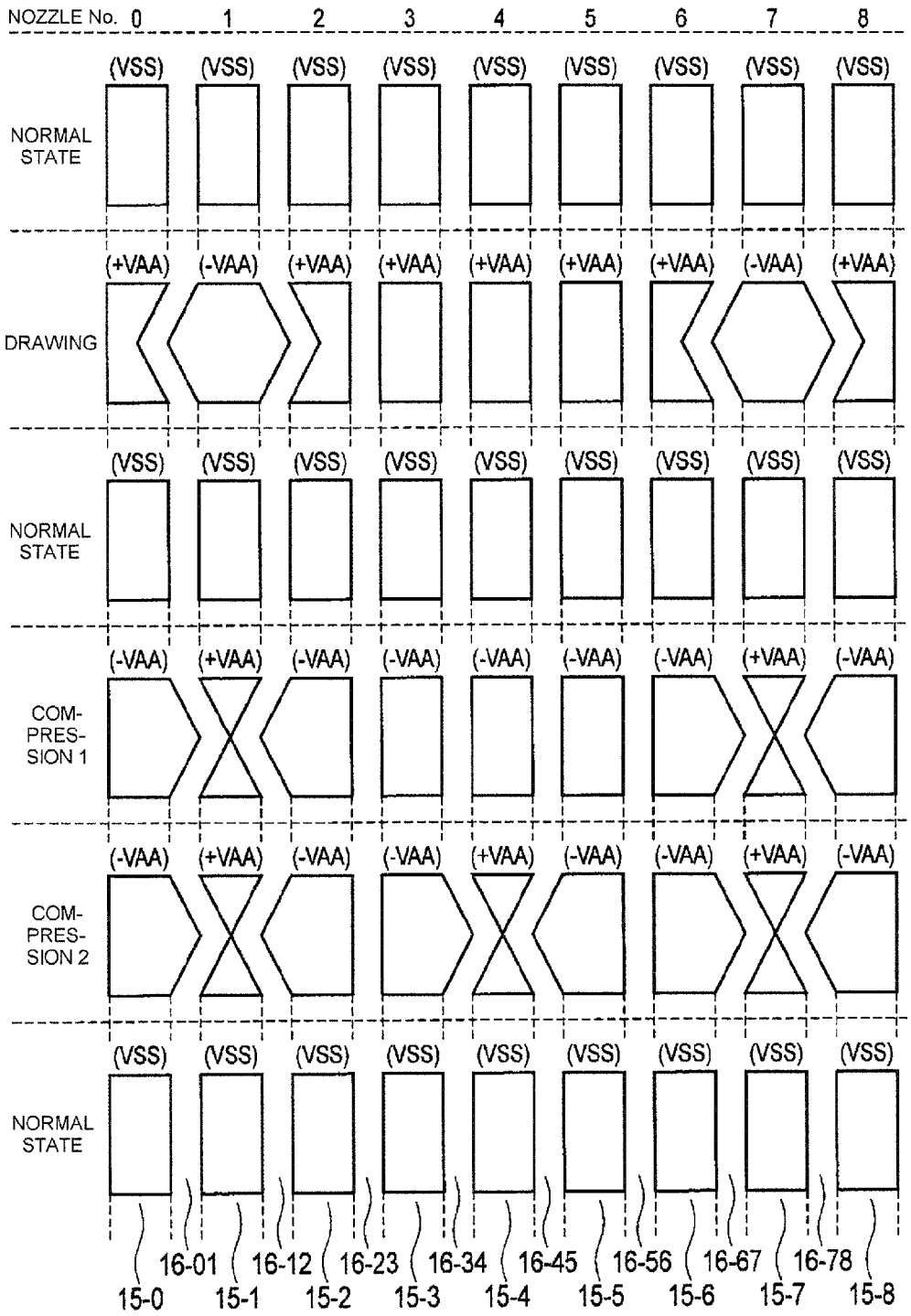
FIG. 6 is a schematic diagram illustrating another example of a relationship between an ink chamber state and a driving pulse voltage when the line inkjet head is driven in a three-division manner.

With reference to FIGS. 5 and 6, a description will be made of a variation in a state of each ink chamber 15 when the head 100 is driven in a three-division manner and of a relationship with a driving pulse voltage which is applied to the electrode 4 of each ink chamber 15 according to the state variation. In addition, the nozzle No. i (where i=0 to 8) in FIGS. 5 and 6 is a unique number assigned to the nozzle 8 which communicates with each corresponding ink chamber 15. In the present exemplary embodiment, the nozzle Nos. i=0, 1, 2, 3, . . . are sequentially added to the respective nozzles 8 from the left when viewed from the outside of the orifice plate 7. Hereinafter, for convenience of description, the nozzle 8 with the nozzle No. i is indicated by the reference sign 8-*i*, and the ink chamber 15 which communicates with the nozzle 8-*i* is indicated by the reference sign 15-*i*. Further, a partition which separates the ink chamber 15-(*i*−1) from the ink chamber 15-*i* is indicated by the reference sign 16-(*i*−1)i.

In FIGS. 5 and 6, the ink chambers 15-0, 15-3 and 15-6 which respectively communicate with the nozzles 8-0, 8-3 and 8-6 with the nozzle Nos. i=0, 3 and 6 belong to the same set; the ink chambers 15-1, 15-4 and 15-7 which respectively communicate with the nozzles 8-1, 8-4 and 8-7 with the nozzle Nos. i=1, 4 and 7 belong to the same set; and, the ink chambers 15-2, 15-5 and 15-8 which respectively communicate with the nozzles 8-2, 8-5 and 8-8 with the nozzle Nos. i=2, 5 and 8 belong to the same set.

FIG. 5 illustrates a case where ink is ejected from the respective nozzles 8-1, 8-4 and 8-7 with the nozzle Nos. i=1, 4 and 7. In this case, the respective ink chambers 15-0 to 15-8 vary in order of a normal state, a drawing state, a normal state, a compression state, and a normal state.

In the normal state, the driving device sets the electrodes 4 of the respective ink chambers 15-0 to 15-8 to a ground voltage VSS. In the drawing state, the driving device applies the negative voltage −VAA to the respective electrodes 4 of the ink chambers 15-1, 15-4 and 15-7 which are ink ejection targets, and applies the positive voltage +VAA to the respective electrodes 4 of the ink chambers 15-0, 15-2, 15-3, 15-5, 15-6 and 15-8 which are disposed adjacent to both sides of the ink chambers 15-1, 15-4 and 15-7. In other words, the pattern illustrated in FIG. 4B occurs. Conversely, in the compression state, the driving device applies the positive voltage +VAA to the respective electrodes 4 of the ink chambers 15-1, 15-4 and 15-7, and applies the negative voltage −VAA to the respective electrodes 4 of the ink chambers 15-0, 15-2, 15-3, 15-5, 15-6 and 15-8. In other words, the pattern illustrated in FIG. 4C occurs. Ink droplets are ejected from the nozzles 8-1, 8-4 and 8-7 due to the state variations of the respective ink chambers 15-0 to 15-8 illustrated in FIG. 5.

FIG. 6 illustrates a case where ink is ejected from the respective nozzles 8-1 and 8-7 with the nozzle Nos. i=1 and 7, and the ink chamber 15-4 which communicates with the nozzle 8-4 with the nozzle No. i=4 belonging to the same set as the nozzle Nos. i=1 and 7 performs an assistance operation for absorbing pressure vibration in the ink chambers 15-1 and 15-7. In this case, the respective ink chambers 15-0 to 15-8 vary in order of a normal state, a drawing state, a normal state, a first compression state, a second compression state, and a normal state.

In the normal state, the driving device sets the electrodes 4 of the respective ink chambers 15-0 to 15-8 to the ground voltage VSS. In the drawing state, the driving device applies the negative voltage −VAA to the respective electrodes 4 of the ink chambers 15-1 and 15-7 which are ink ejection targets, and applies the positive voltage +VAA to the respective electrodes 4 of the ink chambers 15-0 and 15-2 and the ink chambers 15-6 and 15-8 which are disposed adjacent to both sides thereof. Due to the control of the driving pulse voltages, volumes of the ink chambers 15-1 and 15-7 increase.

Here, in the ink chamber 15-2 adjacent to the ink chamber 15-1, the partition 16-12 of the ink chamber 15-1 side is deformed, and thus there is a probability that ink droplets may be erroneously ejected. Therefore, the driving device controls the driving pulse voltages so that the partition 16-23 of the ink chamber 15-3 side is not deformed. In other words, the driving device also applies a voltage with the same potential as a potential of the electrode 4 of the ink chamber 15-2, that is, the positive voltage +VAA to the electrode 4 of the ink chamber 15-3. The electrode 4 of the ink chamber 15-2 has the same potential as the potential of the electrode 4 of the ink chamber 15-3, and thus the partition 16-23 interposed between the ink chamber 15-2 and the ink chamber 15-3 is not deformed.

For the same reason, the driving device also applies the positive voltage +VAA to the electrode 4 of the ink chamber 15-5 adjacent to the ink chamber 15-6. As a result, the electrodes of the ink chambers 15-3 and 15-5 disposed on both sides of the ink chamber 15-4 which performs the assistance operation have the positive voltage +VAA. Therefore, the driving device also applies the positive voltage +VAA to the electrode of the ink chamber 15-4 so that the partitions 16-34 and 16-45 on both sides of the ink chamber 15-4 are not deformed.

In the first compression state, the driving device applies the positive voltage +VAA to the electrodes 4 of the ink chambers 15-1 and 15-7, and applies the negative voltage −VAA to the respective electrodes 4 of the ink chambers 15-0 and 15-2 and the ink chambers 15-6 and 15-8 disposed adjacent to both sides thereof. In addition, from the viewpoint of preventing the above-described ejection error, the driving device also applies the negative voltage −VAA to the electrodes 4 of the ink chamber 15-4 performing the assistance operation and the ink chambers 15-3 and 15-5 adjacent to both sides thereof.

In the second compression state, the driving device applies the positive voltage +VAA to the electrode 4 of the ink chamber 15-4 performing the assistance operation. When the positive voltage +VAA is applied to the electrode 4 of the ink chamber 15-4, a potential difference occurs in the electrodes 4 disposed in the partitions 16-34 and 16-45 on both sides of the ink chamber 15-4, and thus both the partitions 16-34 and 16-45 are deformed in a direction in which the ink chamber 15-4 is compressed. Due to this deformation, the pressure vibration occurring in the ink chamber 15-1 and the ink chamber 15-7 is absorbed.

As illustrated in FIG. 5, patterns of the driving pulse voltages applied to the electrodes 4 are the same as each other in the respective electrodes of the ink chambers 15-0, 15-2, 15-3, 15-5, 15-6 and 15-8 which are located adjacent to both sides of the ink chambers 15-1, 15-4 and 15-7 which are ink ejection targets. In addition, as illustrated in FIG. 6, patterns of the driving pulse voltages applied to the electrodes 4 are the same as each other in the respective electrodes of the ink chambers 15-3 and 15-5 which are located adjacent to both sides of the ink chamber 15-4 performing the assistance operation. For this reason, the electrodes of at least three ink chambers 15, which are arranged in parallel so as to be separated from each other by mutually adjacent partitions, frequently have the same potential in a control sequence of driving pulse voltages for the head 100.

As described above, the share mode type head 100 is equivalent to a circuit in which capacitors are connected in series from the electrical viewpoint, and has floating capacitors. For this reason, if the electrodes of at least three ink chambers 15 arranged in parallel have the same potential, noise current occurs in the head 100, and thus power is wastefully consumed. In order to prevent this defect, in the present exemplary embodiment, a physical property of a capacitor described with reference to FIG. 7 is used.

Figure 7:
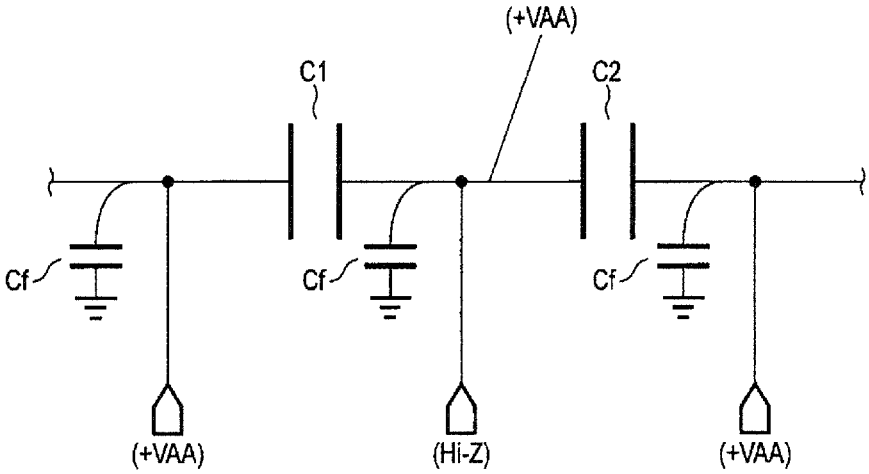
FIG. 7 is a circuit diagram illustrating a physical property of a capacitor used in a first exemplary embodiment.

FIG. 7 illustrates a series circuit of capacitors C1 and C2. In addition, in FIG. 7, the reference sign Cf indicates a floating capacitor. In this series circuit, a high impedance (Hi-Z) state occurs between the capacitor C1 and the capacitor C2. In this state, if voltages (in FIG. 7, the positive voltage +VAA) with the same potential are simultaneously applied to both ends of the series circuit, an induced voltage with the same potential (in FIG. 7, the positive voltage +VAA) as the potential of the applied voltage is generated between the capacitor C1 and the capacitor C2. In other words, the series circuit of capacitors has a property in which, if voltages with the same potential are simultaneously applied to both ends of the circuit, an induced voltage with the same potential as the potential of the applied voltages is generated between the capacitors.

Therefore, the driving device sets the electrode 4 of the ink chamber **15-*i* located inside among at least three ink chambers 15-(*i*−1), 15-*i* and 15-(*i*+1) which are arranged in parallel with the partitions interposed therebetween, to a high impedance state. In addition, the driving device simultaneously applies voltages with the same potential to the electrodes 4 of the ink chambers 15-($i$−1) and 15-(i+1) located on both sides thereof. Then, a voltage with the same potential is also included in the electrode 4 of the ink chamber 15-$i$ located inside. As a result, potentials of the electrodes 4 of at least three ink chambers 15-($i$−1), 15-$i$ and 15**-($i$+1) which are arranged in parallel have the same potential.

Here, the potential of the electrode 4 disposed in the ink chamber 15-$i$ is caused by the induced voltage, and thus a driving pulse voltage is not applied to the electrode 4 thereof. Therefore, there is no occurrence of noise current or wasteful power consumption caused by a floating capacitor.

Figure 8:
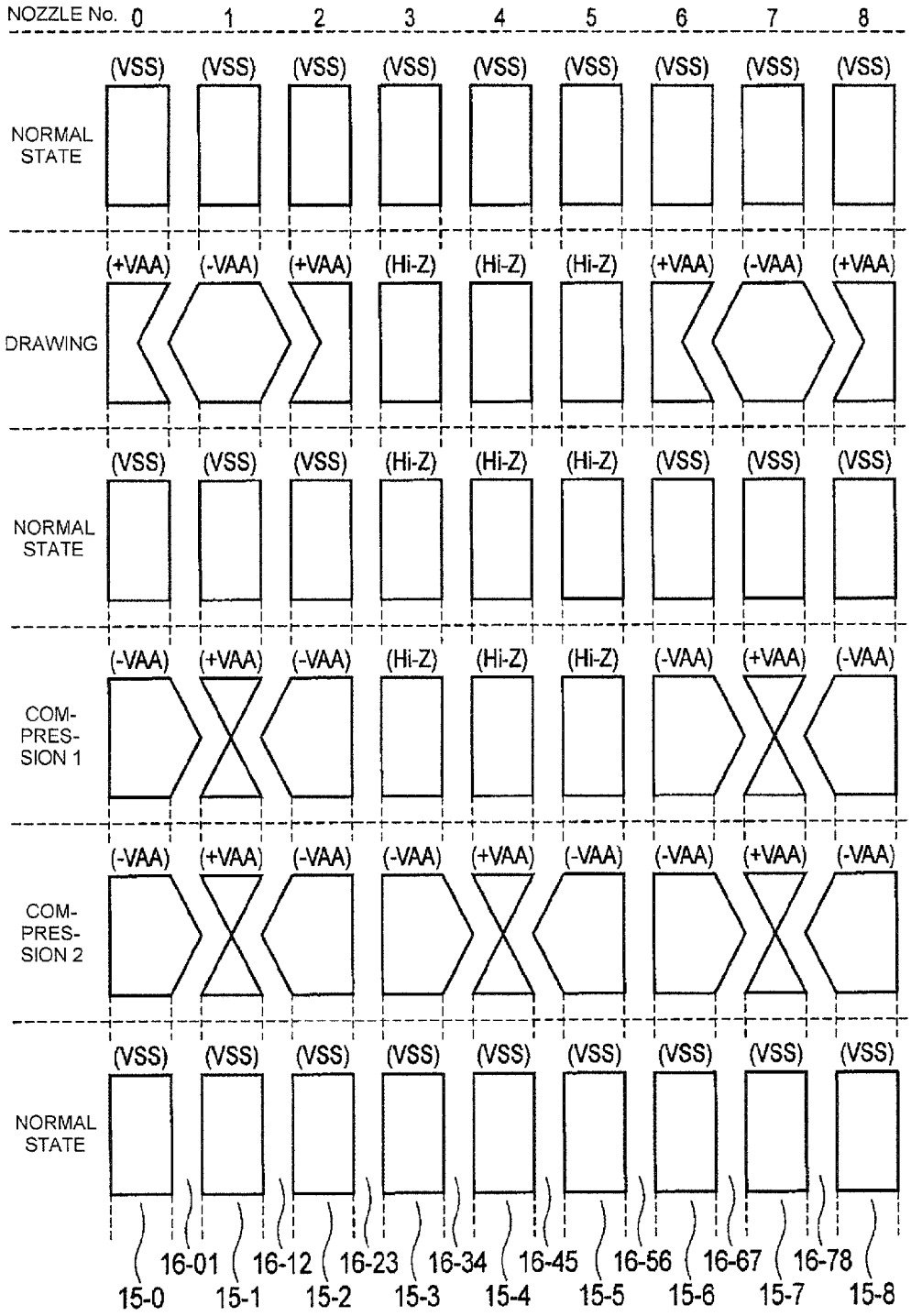
FIG. 8 is a schematic diagram illustrating an example of a relationship between an ink chamber state and a driving pulse voltage when the line inkjet head is driven in a three-division manner in the first exemplary embodiment.

FIG. 8 illustrates a specific example in which the above-described physical property is applied to the patterns of the driving pulse voltages illustrated in FIG. 6. As illustrated in FIG. 6, in five ink chambers 15-2 to 15-6 arranged in parallel centering on the ink chamber 15-4 performing the assistance operation, the patterns of driving pulse voltages applied to the respective electrodes 4 are common from the drawing state to the first compression state. Therefore, as illustrated in FIG. 8, in relation to the three ink chambers 15-3 to 15-5 other than the ink chambers 15-2 and 15-6 located on both sides among the five ink chambers 15-2 to 15-6, a controller sets the electrodes 4 thereof to a high impedance state from the drawing state to the first compression state.

The driving device applies the positive voltage +VAA to the electrodes 4 of the ink chambers 15-2 and 15-6 located on both sides at the timing of the drawing state. Therefore, the positive voltage +VAA is induced in the electrodes 4 of the ink chambers 15-3 to 15-5 located inside, as in a pattern P1 illustrated in an equivalent circuit diagram of FIG. 9. As a result, voltage patterns of the electrodes disposed in the ink chambers 15-2 to 15-6 match the voltage pattern in the drawing state.

Successively, at the timing of the normal state, the driving device sets the electrodes 4 of the ink chambers 15-2 and 15-6 located on both sides to the ground voltage VSS. Therefore, as in a pattern P2, the electrodes 4 of the ink chambers 15-3 to 15-5 located inside are also set to the ground voltage VSS. As a result, voltage patterns of the respective electrodes match the voltage pattern in the normal state.

Successively, at the timing of the first compression state, the driving device applies the negative voltage −VAA to the electrodes 4 of the ink chambers 15-2 and 15-6 located on both sides. Therefore, as in a pattern P3, the negative voltage −VAA is induced in the electrodes 4 of the ink chambers 15-3 to 15-5 located inside. As a result, voltage patterns of the respective electrodes 4 conform to the voltage pattern in the first compression state.

As above, even if the respective electrodes 4 of the ink chamber 15-4 performing the assistance operation and both the adjacent ink chambers 15-3 and 15-5 thereof are controlled so as to be in a high impedance state in the section from the drawing state to the first compression state, voltages are induced in the electrodes 4 of the respective ink chambers 15-3, 15-4 and 15-5 in the same pattern as in FIG. 6. Therefore, there is no influence on an ink ejection operation.

Figure 9:
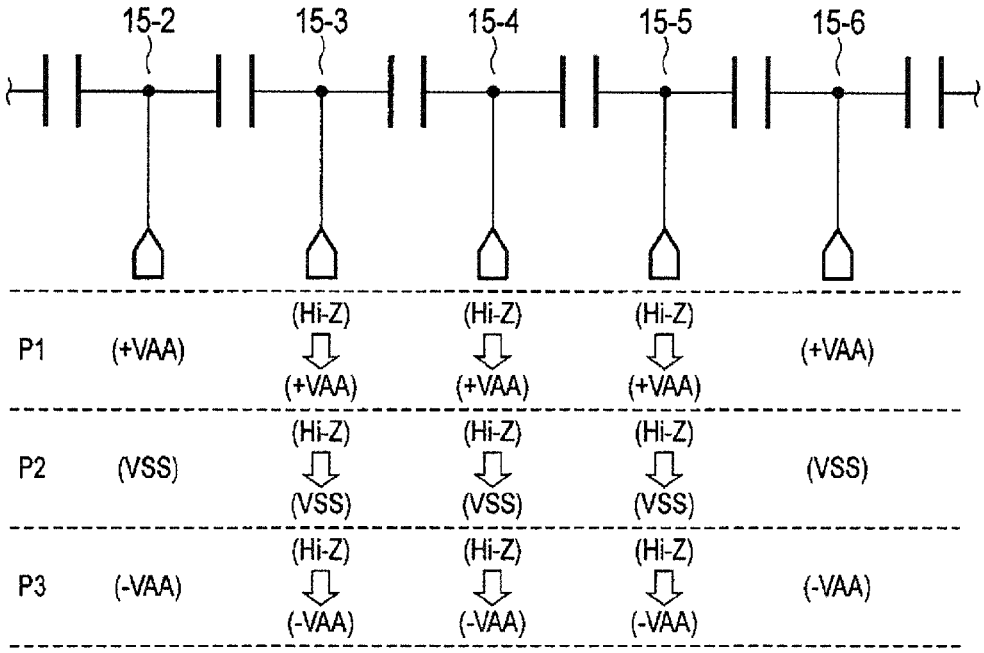
FIG. 9 is a diagram illustrating an equivalent circuit of the line inkjet head and an example of an applied voltage pattern.

In addition, although, in FIG. 9, the electrodes 4 of the ink chambers 15-3 to 15-5 located inside are also set to a high impedance state in the normal state following the drawing state, a voltage pattern may be controlled so that the electrodes are not set to a high impedance state but have the ground voltage VSS in the normal state.

Figure 10:
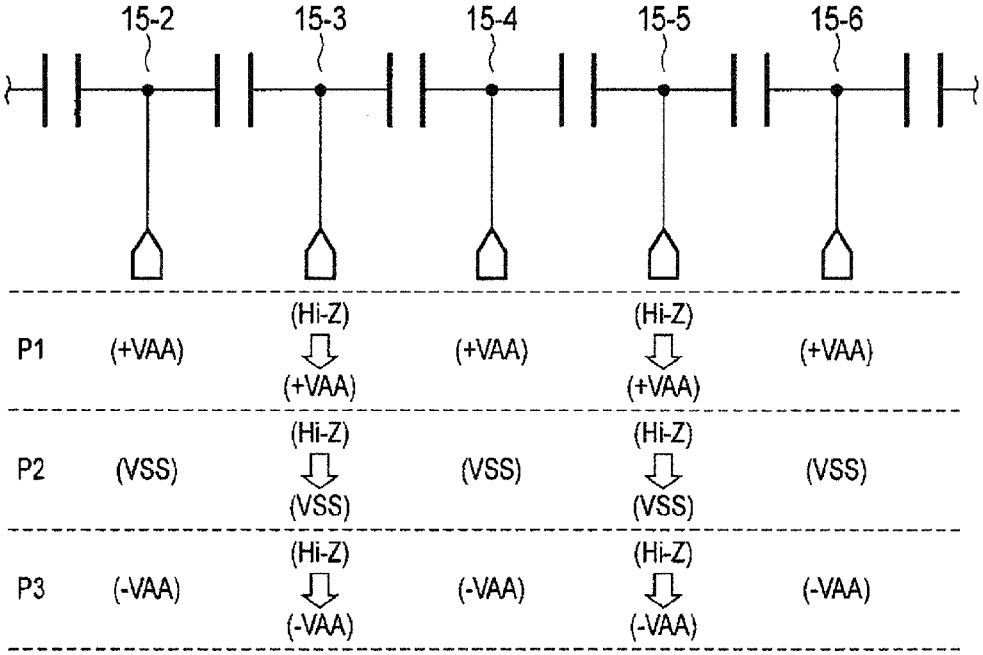
FIG. 10 is a diagram illustrating an equivalent circuit of the line inkjet head and another example of an applied voltage pattern.

In addition, as illustrated in FIG. 10, the electrode 4 of the ink chamber 15-4 performing the assistance operation among the ink chambers 15-3 to 15-5 located inside may not be set to a high impedance state, and only the electrodes 4 of the ink chambers 15-3 and 15-5 adjacent to both sides thereof may be set to a high impedance state. In this way, a voltage applied to the ink chambers 15-2 and 15-4 located adjacent to both sides of the ink chamber 15-3 is induced in the electrode 4 of the ink chamber 15-3, and a voltage applied to the ink chambers 15-4 and 15-6 located adjacent to both sides of the ink chamber 15-5 is induced in the electrode 4 of the ink chamber 15-5. Therefore, potentials of the respective electrodes 4 of the five ink chambers 15-2 to 15-6 arranged in parallel are reliably the same as each other.

Figure 11:
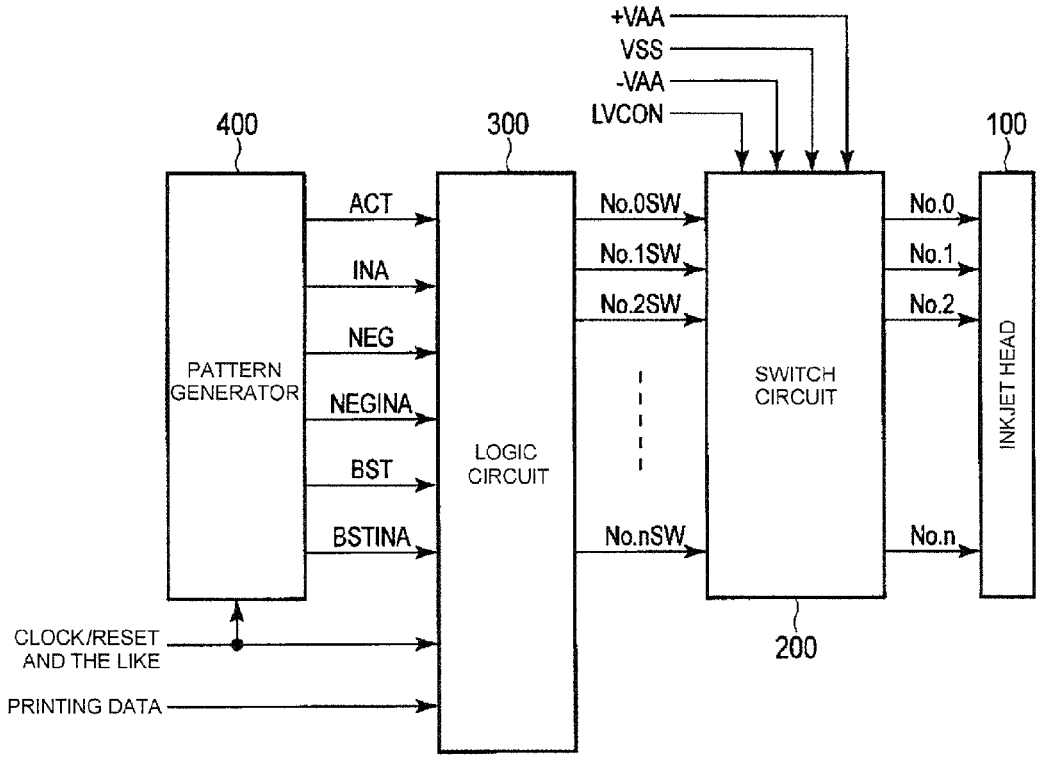
FIG. 11 is a block diagram illustrating a schematic configuration of a line inkjet head driving device.

FIG. 11 is a block diagram illustrating a driving device of the head 100. The driving device includes a switch circuit 200, a logic circuit 300, and a pattern generator 400.

The switch circuit 200 includes (n+1) control switches SWx (where x=0 to n) which respectively correspond to all the nozzles 8-0 to 8-$n$ with the nozzle Nos. 0 to n (where n≥1) of the head 100. A positive voltage +VAA, a negative voltage −VAA, a ground voltage VSS, and a common voltage LVCON are supplied to the switch circuit 200 from a power supply circuit (not illustrated). In addition, control signals No.xSW (where x=0 to n) for the respective control switches SWx are input to the switch circuit 200 from the logic circuit 300. Further, the common voltage LVCON is selected from the positive voltage +VAA, the negative voltage −VAA, and the ground voltage VSS, and is applied in common to the all the control switches SWx.

Figures 12, 13:
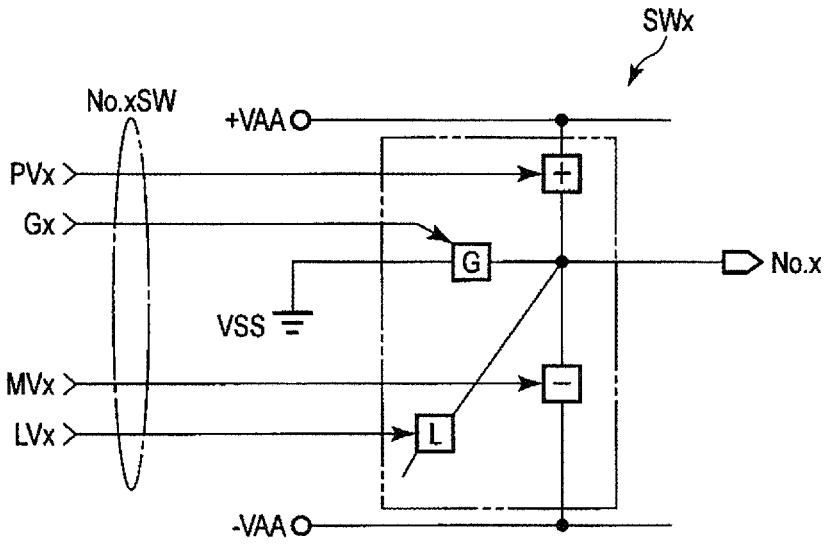
FIG. 12 is a circuit diagram of a control switch.
FIG. 13 is a diagram illustrating a truth table used to describe an operation of a logic circuit.

FIG. 12 is a circuit diagram of the control switch SWx. The control switch SWx connects respective output ends of a positive voltage contact point [+], a negative voltage contact point [−], a ground contact point [G], and a common voltage contact point [L], to an output terminal No.x directed to the head 100. An input end of the positive voltage contact point [+] is connected to a terminal of the positive voltage +VAA. An input end of the negative voltage contact point [−] is connected to a terminal of the negative voltage −VAA. An input end of the ground contact point [G] is connected to a terminal of the ground voltage VSS. An input end of the common voltage contact point [L] is connected to a terminal (not illustrated) of the common voltage LVCON. The positive voltage contact point [+] connects the input end to the output end when a positive voltage pulse signal PVx is in an On state. The negative voltage contact point [−] connects the input end to the output end when a negative voltage pulse signal MVx is in an On state. The ground contact point [G] connects the input end to the output end when a ground signal Gx is in an On state. The common voltage contact point [L] connects the input end to the output end when a common voltage signal LVx is in an On state. The positive voltage pulse signal PVx, the negative voltage pulse signal MVx, the ground signal Gx, and the common voltage signal LVx are included in the control signals No.xSW which are input from the logic circuit 300.

The logic circuit 300 sets a state of each of the control switches SWx for each printing line according to printing data supplied from an external apparatus. In addition, the logic circuit 300 generates the control signals No.xSW for the respective control switches SWx so that the respective control switches SWx are turned to the set states. The logic circuit 300 outputs the respective control signals No.xSW to the switch circuit 200 while adjusting output timings so that the respective ink chambers 15 are driven in a three-division manner using a CLOCK/RESET signal.

An ACT signal, an INA signal, an NEG signal, an NEGINA signal, a BST signal, and a BSTINA signal are input to the logic circuit 300 from the pattern generator 400. The ACT signal is a voltage signal with driving pulses which are applied to the electrode 4 of the ink chamber 15 which communicates with a nozzle (hereinafter, referred to as an ejection related nozzle) ejecting ink droplets through the division driving. The INA signal is a voltage signal with driving pulses which are applied to the electrodes 4 of the ink chambers 15 which communicate with nozzles (hereinafter, referred to as ejection both-adjacent nozzles) adjacent to both sides of the ejection related nozzle. The NEG signal is a voltage signal with driving pulses which are applied to the electrode 4 of the ink chamber 15 which communicates with a nozzle (hereinafter, referred to as a non-ejection related nozzle) which does not eject ink droplets when division driving is performed. The NEGINA signal is a voltage signal with driving pulses which are applied to the electrodes 4 of the ink chambers 15 which communicate with nozzles (hereinafter, referred to as non-ejection both-adjacent nozzles) adjacent to both sides of the non-ejection related nozzle. The BST signal is a voltage signal with driving pulses which are applied to the electrode 4 of the ink chamber 15 which communicates with a nozzle (hereinafter, referred to as an assistance related nozzle) performing the assistance operation when the division driving is performed. The BSTINA signal is a voltage signal with driving pulses which are applied to the electrodes 4 of the ink chambers 15 which communicate with nozzles (hereinafter, referred to as assistance both-adjacent nozzles) adjacent to both sides of the assistance related nozzle.

The control signal No.xSW for the control switch SWx corresponding to an ejection related nozzle is generated using the ACT signal. The control signals No.xSW for the control switches SWx corresponding to ejection both-adjacent nozzles are generated using the INA signal. The control signal No.xSW for the control switch SWx corresponding to a non-ejection related nozzle is generated using the NEG signal. The control signals No.xSW for the control switches SWx corresponding to non-ejection both-adjacent nozzles are generated using the NEGINA signal. The control signal No.xSW for the control switch SWx corresponding to an assistance related nozzle is generated using the BST signal. The control signals No.xSW for the control switches SWx corresponding to assistance both-adjacent nozzles are generated using the BSTINA signal.

Codes indicating driving pulse voltages in time series include a 2-bit potential code and a 1-bit high impedance designation code (hereinafter, simply referred to as a Hi-Z designation code) as described on the left side of a truth table 500 illustrated in FIG. 13.

The logic circuit 300 generates the control signals No.xSW according to the truth table 500. In other words, when the potential code is [00] and the Hi-Z designation code is [0], the logic circuit 300 generates the control signals No.xSW in which the ground signal Gx is in an On state. When the potential code is [01] and the Hi-Z designation code is [0], the logic circuit 300 generates the control signals No.xSW in which the positive voltage pulse signal PVx is in an On state. When the potential code is [10] and the Hi-Z designation code is [0], the logic circuit 300 generates the control signals No.xSW in which the negative voltage pulse signal MVx is in an On state. When the potential code is [11] and the Hi-Z designation code is [0], the logic circuit 300 generates the control signals No.xSW in which the common voltage signal LVx is in an On state.

In addition, when the Hi-Z designation code is [1] regardless of the potential code, the logic circuit 300 generates the control signals No.xSW in which the positive voltage pulse signal PVx, the negative voltage pulse signal MVx, the ground signal Gx, and the common voltage signal LVx are all in an Off state. In other words, the Hi-Z designation code has a priority higher than the potential code.

The electrode 4 of the ink chamber 15 which communicates with an ejection related nozzle is controlled to have a high impedance state by the control signals No.xSW. Therefore, for convenience of description, the control signals No.xSW in which the positive voltage pulse signal PVx, the negative voltage pulse signal MVx, the ground signal Gx, and the common voltage signal LVx are all in an Off state are referred to as high impedance control signals. Here, the logic circuit 300 functions as a controller which sets the electrode 4 disposed on the wall surface of the ink chamber 15 to a high impedance state.

Figure 14:
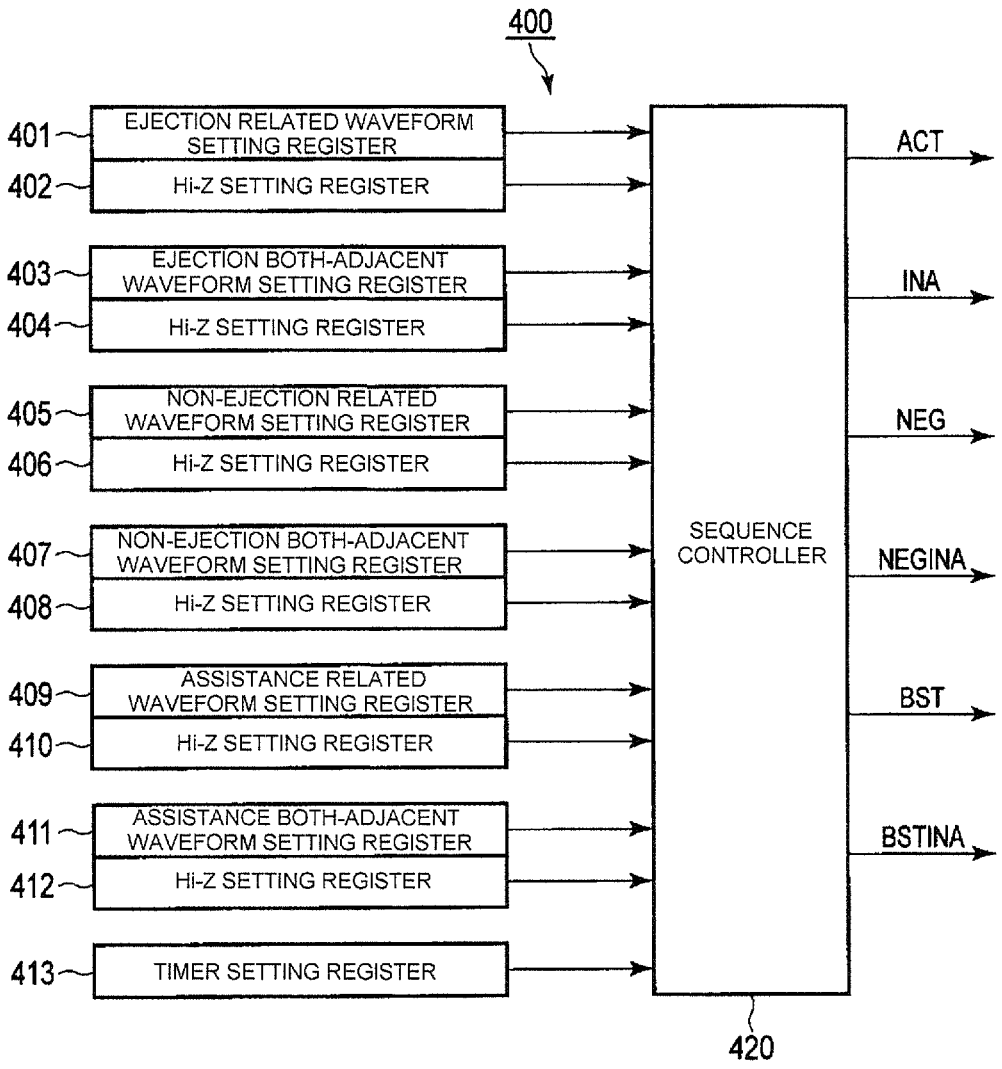
FIG. 14 is a block diagram illustrating a configuration of a pattern generator.

FIG. 14 is a block configuration diagram of the pattern generator 400. The pattern generator 400 includes a register group and a sequence controller 420. The register group includes an ejection related waveform setting register 401, an ejection both-adjacent waveform setting register 403, a non-ejection related waveform setting register 405, a non-ejection both-adjacent waveform setting register 407, an assistance related waveform setting register 409, and an assistance both-adjacent waveform setting register 411, high impedance setting registers (hereinafter, simply referred to as Hi-Z setting registers) 402, 404, 406, 408, 410 and 412 which respectively correspond to the waveform setting registers 401, 403, 405, 407, 409 and 411, and a timer setting register 413.

A potential code which indicates in time series a voltage waveform of driving pulses applied to the electrode 4 of the ink chamber 15 which communicates with the ejection related nozzle is set in the ejection related waveform setting register 401. A potential code which indicates in time series a voltage waveform of driving pulses applied to the electrodes 4 of the ink chambers 15 which communicate with the ejection both-adjacent nozzles is set in the ejection both-adjacent waveform setting register 403. A potential code which indicates in time series a voltage waveform of driving pulses applied to the electrode 4 of the ink chamber 15 which communicates with the non-ejection related nozzle is set in the non-ejection related waveform setting register 405. A potential code which indicates in time series a voltage waveform of driving pulses applied to the electrodes 4 of the ink chambers 15 which communicate with the non-ejection both-adjacent nozzles is set in the non-ejection both-adjacent waveform setting register 407. A potential code which indicates in time series a voltage waveform of driving pulses applied to the electrode 4 of the ink chamber 15 which communicates with the assistance related nozzle is set in the assistance related waveform setting register 409. A potential code which indicates in time series a voltage waveform of driving pulses applied to the electrodes 4 of the ink chambers 15 which communicate with the assistance both-adjacent nozzles is set in the assistance both-adjacent waveform setting register 411.

A Hi-Z designation code, which indicates in time series whether or not the electrodes 4 to which driving pulse voltage patterns set in the corresponding waveform setting registers 401, 403, 405, 407, 409 and 411 are applied are controlled to have a high impedance state, is set in the respective Hi-Z setting registers 402, 404, 406, 408, 410 and 412.

A timer value, which indicates a timing when a code is read from each of the waveform setting registers 401 to 412, is set in the timer setting register 413.

The sequence controller 420 sequentially reads the potential code and the Hi-Z designation code from the ejection related waveform setting register 401 and the Hi-Z setting register 402 according to the timer value set in the timer setting register 413. In addition, the sequence controller 420 generates the ACT signal (ejection related driving pulses) from the two kinds of read codes, and outputs the ACT signal to the logic circuit 300.

Similarly, the sequence controller 420 generates the INA signal (ejection both-adjacent driving pulses) from two kinds of codes which are read from the ejection both-adjacent waveform setting register 403 and the Hi-Z setting register 404, and outputs the INA signal to the logic circuit 300. In addition, the sequence controller 420 generates the NEG signal (non-ejection related driving pulses) from two kinds of codes which are read from the non-ejection related waveform setting register 405 and the Hi-Z setting register 406, and outputs the NEG signal to the logic circuit 300. Further, the sequence controller 420 generates the NEGINA signal (non-ejection both-adjacent driving pulses) from two kinds of codes which are read from the non-ejection both-adjacent waveform setting register 407 and the Hi-Z setting register 408, and outputs the NEGINA signal to the logic circuit 300. Furthermore, the sequence controller 420 generates the BST signal (assistance related driving pulses) from two kinds of codes which are read from the assistance related waveform setting register 409 and the Hi-Z setting register 410, and outputs the BST signal to the logic circuit 300. Moreover, the sequence controller 420 generates the BSTINA signal (assistance both-adjacent driving pulses) from two kinds of codes which are read from the assistance both-adjacent waveform setting register 411 and the Hi-Z setting register 412, and outputs the BSTINA signal to the logic circuit 300.

Figure 15:
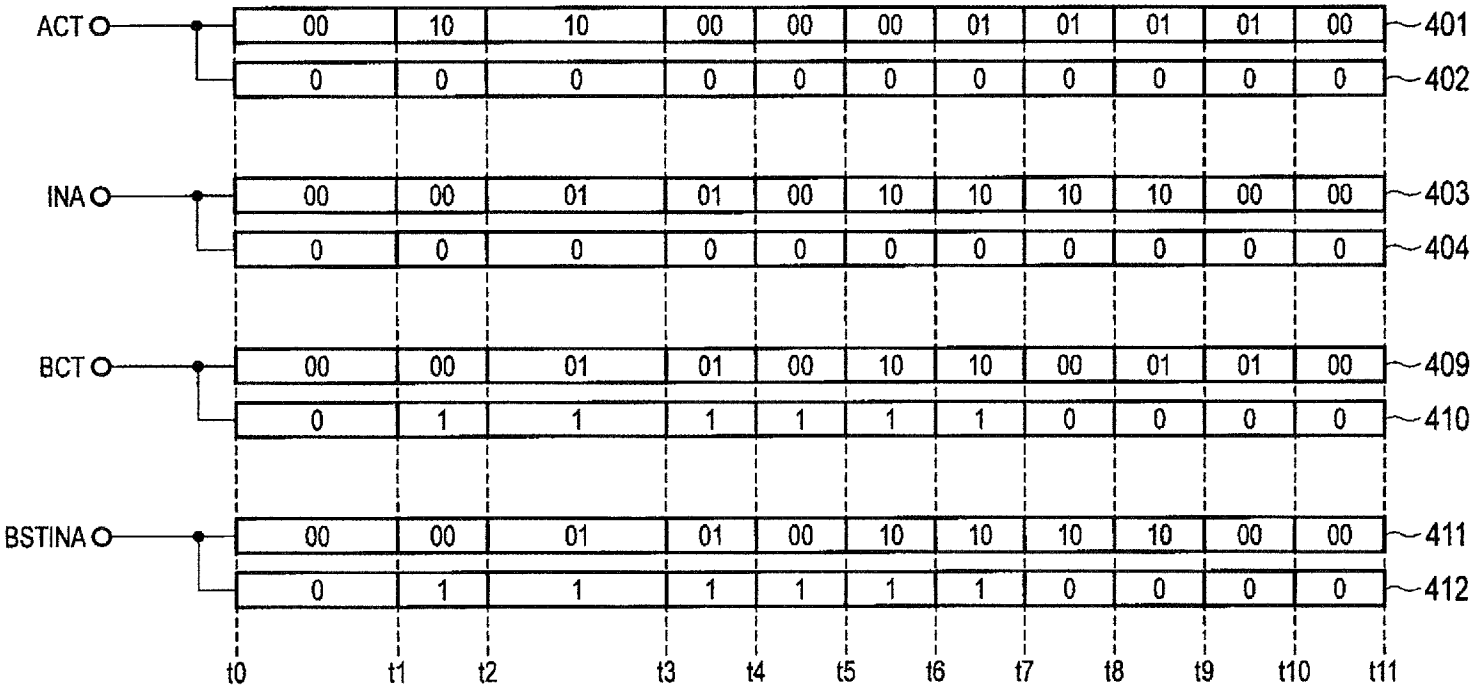
FIG. 15 is a schematic diagram illustrating an example of a coding scheme which is set in main registers of a register group forming the pattern generator.

FIG. 15 illustrates an example of potential codes set in the ejection related waveform setting register 401, the ejection both-adjacent waveform setting register 403, the assistance related waveform setting register 409, and the assistance both-adjacent waveform setting register 411, and Hi-Z designation codes set in the Hi-Z setting registers 402, 404, 410 and 412 which respectively correspond to the registers. This example corresponds to the pattern of applying driving pulse voltages illustrated in FIG. 8.

In FIG. 15, a section from the time point t0 to the time point t1 corresponds to the normal state. A section from the time point t1 to the time point t4 corresponds to the drawing state. A section from the time point t4 to the time point t5 corresponds to the normal state following the drawing state. A section from the time point t5 to the time point t7 corresponds to the first compression state. A section from the time point t7 to the time point t10 corresponds to the second compression state. A section from the time point t10 to the time point t11 corresponds to the normal state following the second compression state.

In the section from t0 to t1, a potential code of the ejection related waveform setting register 401 is "00", and a Hi-Z designation code of the Hi-Z setting register 402 is "0". The potential code and the Hi-Z designation code are output to the logic circuit 300 as the ACT signal.

The logic circuit 300 generates control signals No.1SW and No.7SW for the ejection related nozzles 8-1 and 8-7 with the nozzle No. 1 and the nozzle No. 7 on the basis of the ACT signal. In other words, since the potential code is "00", and the Hi-Z designation code is "0", the ground signal Gx is generated as the control signals No.1SW and No.7SW and is output to the switch circuit 200.

In the switch circuit 200, the ground contact point [G] of the control switch SW1 is turned on by the control signal No.1SW. As a result, a potential of the electrode 4 of the ink chamber 15-1 which communicates with the ejection related nozzle 8-1 becomes the ground voltage VSS. Similarly, in the switch circuit 200, the ground contact point [G] of the control switch SW7 is turned on by the control signal No.7SW. As a result, a potential of the electrode 4 of the ink chamber 15-7 which communicates with the ejection related nozzle 8-7 becomes the ground voltage VSS.

In the section from t0 to t1, a potential code of the ejection both-adjacent waveform setting register 403 is "00", and a Hi-Z designation code of the Hi-Z setting register 404 is "0". The potential code and the Hi-Z designation code are output to the logic circuit 300 as the INA signal.

The logic circuit 300 generates control signals No.0SW, No.2SW, No.6SW and No.8SW for the ejection both-adjacent nozzles 8-0, 8-2, 8-6 and 8-8 with the nozzle No. 0, the nozzle No. 2, the nozzle No. 6, and the nozzle No. 8 on the basis of the INA signal. In other words, since the potential code is "00", and the Hi-Z designation code is "0", the ground signal Gx is generated as the control signals No.0SW, No.2SW, No.6SW and No.8SW and is output to the switch circuit 200.

In the switch circuit 200, the ground contact points [G] of the control switches SW0, SW2, SW6 and SW8 are turned on by the control signals No.0SW, No.2SW, No.6SW and No.8SW. As a result, potentials of the electrodes 4 of the ink chambers 15-0, 15-2, 15-6 and 15-8 which communicate with the ejection both-adjacent nozzles 8-0, 8-2, 8-6 and 8-8 become the ground voltage VSS.

In the section from t0 to t1, a potential code of the assistance related waveform setting register 409 is "00", and a Hi-Z designation code of the Hi-Z setting register 410 is "0". The potential code and the Hi-Z designation code are output to the logic circuit 300 as the BST signal. The logic circuit 300 generates a control signal No.4SW for the assistance related nozzle 8-4 with the nozzle No. 4 on the basis of the BST signal. In other words, since the potential code is "00", and the Hi-Z designation code is "0", the ground signal Gx is generated as the control signal No.4SW and is output to the switch circuit 200.

In the switch circuit 200, the ground contact point [G] of the control switch SW4 is turned on by the control signal No.4SW. As a result, a potential of the electrode 4 of the ink chamber 15-4 which communicates with the assistance related nozzle 8-4 becomes the ground voltage VSS.

In the section from t0 to t1, a potential code of the assistance both-adjacent waveform setting register 411 is "00", and a Hi-Z designation code of the Hi-Z setting register 412 is "0". The potential code and the Hi-Z designation code are output to the logic circuit 300 as the BSTINA signal. The logic circuit 300 generates control signals No.3SW and No.5SW for the assistance both-adjacent nozzles 8-3 and 8-5 with the nozzle No. 3 and the nozzle No. 5 on the basis of the BSTINA signal. In other words, since the potential code is "00", and the Hi-Z designation code is "0", the ground signal Gx is generated as the control signals No.3SW and No.5SW and is output to the switch circuit 200.

In the switch circuit 200, the ground contact points [G] of the control switches SW3 and SW5 are turned on by the control signals No.3SW and No.5SW. As a result, potentials of the electrodes 4 of the ink chambers 15-3 and 15-5 which communicate with the assistance related nozzles 8-3 and 8-5 become the ground voltage VSS.

Accordingly, the potentials of the electrodes 4 of the respective ink chambers 15-0 to 15-8 all become the ground voltage VSS. Therefore, the partitions 16-01 to 16-78 which separate the respective ink chambers 15-0 to 15-8 from each other are not deformed.

In the section from t1 to t2, the potential code of the ejection related waveform setting register 401 is changed to "10". In other words, since the potential code is "10", and the Hi-Z designation code is "0", the negative voltage pulse signal MVx is generated as the control signals No.1SW and No.7SW and is output to the switch circuit 200 in the logic circuit 300. In the switch circuit 200, the negative voltage contact points [−] of the control switches SW1 and SW7 are turned on by the control signals No.1SW and No.7SW. As a result, potentials of the electrodes 4 of the ink chambers 15-1 and 15-7 become the negative voltage −VAA.

In addition, in the section from t1 to t2, both of the Hi-Z designation codes of the Hi-Z setting register 410 corresponding to the assistance related waveform setting register 409 and the Hi-Z setting register 412 corresponding to the assistance both-adjacent waveform setting register 411 are changed to "1". For this reason, in the logic circuit 300, the high impedance control signals are generated as the control signals No.3SW, No.4SW and No.5SW, and are output to the switch circuit 200. In the switch circuit 200, the control switches SW3, SW4 and SW5 are turned off by the high impedance control signals. As a result, the respective electrodes 4 of the ink chambers 15-3, 15-4 and 15-5 are turned to a high impedance state.

In the section from t2 to t3, the respective potential codes of the ejection both-adjacent waveform setting register 403, the assistance related waveform setting register 409, and the assistance both-adjacent waveform setting register 411 are all changed to "01". However, the Hi-Z designation codes of the Hi-Z setting registers 410 and 412 remain "1". For this reason, in the logic circuit 300, the positive voltage pulse signal PVx is generated as the control signals No.0SW, No.2SW, No.6SW and No.8SW and is output to the switch circuit 200. The control signals No.3SW, No.4SW and No.5SW are still the high impedance control signals. In the switch circuit 200, the positive voltage contact points [+] of the control switches SW0, SW2, SW6 and SW8 are turned on by the control signals No.0SW, No.2SW, No.6SW and No.8SW. As a result, potentials of the electrodes 4 of the ink chambers 15-0, 15-2, 15-6 and 15-8 become the positive voltage +VAA. The respective electrodes 4 of the ink chambers 15-3, 15-4 and 15-5 are continuously in a high impedance state.

Accordingly, the partitions 16-01 and 16-12 between the ink chamber 15-0 and the ink chamber 15-1 and between the ink chamber 15-1 and the ink chamber 15-2, and the partitions 16-67 and 16-78 between the ink chamber 15-6 and the ink chamber 15-7 and between the ink chamber 15-7 and the ink chamber 15-8 are deformed so as to increase volumes of the ink chambers 15-1 and 15-7 which communicate with the ejection related nozzles No. 1 and No. 7. On the other hand, the respective electrodes 4 of the ink chambers 15-3, 15-4 and 15-5 are in a high impedance state, and both potentials of the electrodes 4 of the ink chambers 15-2 and 15-6 on both sides thereof are the positive voltage +VAA. For this reason, the positive voltage +VAA is induced in the respective electrodes 4 of the ink chambers 15-3, 15-4 and 15-5. Therefore, a potential difference does not occur in the partitions 16-23, 16-34, 16-45 and 16-56 which respectively separate the chambers including the ink chamber 15-2 to the ink chamber 15-6 from each other, and thus the partitions 16-23, 16-34, 16-45 and 16-56 are not deformed.

In the section from t3 to t4, the potential code of the ejection related waveform setting register 401 is changed to "00". For this reason, in the logic circuit 300, the ground signal Gx is generated as the control signals No.1SW and No.7SW and is output to the switch circuit 200. In the switch circuit 200, the ground contact points [G] of the control switches SW1 and SW7 are turned on by the control signals No.1SW and No.7SW. As a result, potentials of the electrodes 4 of the ink chambers 15-1 and 15-7 become the ground voltage VSS.

In the section from t4 to t5, the respective potential codes of the ejection both-adjacent waveform setting register 403, the assistance related waveform setting register 409, and the assistance both-adjacent waveform setting register 411 are all changed to "00". However, the Hi-Z designation codes of the Hi-Z setting registers 410 and 412 remain "1". For this reason, in the logic circuit 300, the ground signal Gx is generated as the control signals No.0SW, No.2SW, No.6SW and No.8SW and is output to the switch circuit 200. The control signals No.3SW, No.4SW and No.5SW are still the high impedance control signals. In the switch circuit 200, the ground contact points [G] of the control switches SW0, SW2, SW6 and SW8 are turned on by the control signals No.0SW, No.2SW, No.6SW and No.8SW. As a result, potentials of the electrodes 4 of the ink chambers 15-0, 15-2, 15-6 and 15-8 become the ground voltage VSS. The respective electrodes 4 of the ink chambers 15-3, 15-4 and 15-5 are continuously in a high impedance state.

Accordingly, the partitions 16-01 and 16-12 between the ink chamber 15-0 and the ink chamber 15-1 and between the ink chamber 15-1 and the ink chamber 15-2, and the partitions 16-67 and 16-78 between the ink chamber 15-6 and the ink chamber 15-7 and between the ink chamber 15-7 and the ink chamber 15-8 are returned to a normal state. At this time, the respective electrodes 4 of the ink chambers 15-3, 15-4 and 15-5 are in a high impedance state, and both potentials of the electrodes 4 of the ink chambers 15-2 and 15-6 on both sides thereof become the ground voltage VSS. For this reason, potentials of the respective electrodes 4 of the ink chambers 15-3, 15-4 and 15-5 also become the ground voltage VSS. Therefore, the partitions 16-23, 16-34, 16-45 and 16-56 are not deformed.

In the section from t5 to t6, the potential codes of the ejection both-adjacent waveform setting register 403, the assistance related waveform setting register 409, and the assistance both-adjacent waveform setting register 411 are all changed to "10". However, the Hi-Z designation codes of the Hi-Z setting registers 410 and 412 remain "1". For this reason, in the logic circuit 300, the negative voltage pulse signal MVx is generated as the control signals No.0SW, No.2SW, No.6SW and No.8SW and is output to the switch circuit 200. The control signals No.3SW, No.4SW and No.5SW are still the high impedance control signals. In the switch circuit 200, the negative voltage contact points [−] of the control switches SW0, SW2, SW6 and SW8 are turned on by the control signals No.0SW, No.2SW, No.6SW and No.8SW. As a result, potentials of the electrodes 4 of the ink chambers 15-0, 15-2, 15-6 and 15-8 become the negative voltage −VAA. The respective electrodes 4 of the ink chambers 15-3, 15-4 and 15-5 are continuously in a high impedance state.

In the section from t6 to t7, the potential code of the ejection related waveform setting register 401 is changed to "01". For this reason, the positive voltage pulse signal PVx is generated as the control signals No.1SW and No.7SW and is output to the switch circuit 200 in the logic circuit 300. In the switch circuit 200, the positive voltage contact points [+] of the control switches SW1 and SW7 are turned on by the control signals No.1SW and No.7SW. As a result, potentials of the electrodes 4 of the ink chambers 15-1 and 15-7 become the positive voltage +VAA.

Accordingly, the partitions 16-01 and 16-12 between the ink chamber 15-0 and the ink chamber 15-1 and between the ink chamber 15-1 and the ink chamber 15-2, and the partitions 16-67 and 16-78 between the ink chamber 15-6 and the ink chamber 15-7 and between the ink chamber 15-7 and the ink chamber 15-8 are deformed so as to decrease volumes of the ink chambers 15-1 and 15-7 which communicate with the ejection related nozzles No. 1 and No. 7. At this time, the respective electrodes 4 of the ink chambers 15-3, 15-4 and 15-5 are in a high impedance state, and both potentials of the electrodes 4 of the ink chambers 15-2 and 15-6 on both sides thereof are the negative voltage −VAA. For this reason, the negative voltage −VAA is induced in the respective electrodes 4 of the ink chambers 15-3, 15-4 and 15-5. Therefore, the partitions 16-23, 16-34, 16-45 and 16-56 are not deformed.

In the section from t7 to t8, the potential code of the assistance related waveform setting register 409 is changed to "00". In addition, both of the Hi-Z designation codes of the Hi-Z setting register 410 corresponding to the assistance related waveform setting register 409 and the Hi-Z setting register 412 corresponding to the assistance both-adjacent waveform setting register 411 become "0". For this reason, in the logic circuit 300, the ground signal Gx is generated as the control signal No.4SW and is output to the switch circuit 200. In addition, in the logic circuit 300, the negative voltage pulse signal MVx is generated as the control signals No.3SW and No.5SW and is output to the switch circuit 200. In the switch circuit 200, the ground contact point [G] of the control switch SW4 is turned on by the control signal No.4SW. Further, in the switch circuit 200, the negative voltage contact points [−] of the control switches SW3 and SW5 are turned on by the control signals No.3SW and No.5SW. As a result, a potential of the electrode 4 of the ink chamber 15-4 becomes the ground voltage VSS. Furthermore, potentials of the electrodes 4 of the ink chambers 15-3 and 15-5 become the negative voltage −VAA.

In the section from t8 to t9, the potential code of the assistance related waveform setting register 409 is changed to "01". For this reason, in the logic circuit 300, the positive voltage pulse signal PVx is generated as the control signal No.4SW and is output to the switch circuit 200. In the switch circuit 200, the positive voltage contact point [+] of the control switch SW4 is turned on by the control signal No.4SW. As a result, a potential of the electrode 4 of the ink chamber 15-4 becomes the positive voltage +VAA.

Accordingly, the partitions 16-34 and 16-45 between the ink chamber 15-3 and the ink chamber 15-4 and between the ink chamber 15-4 and the ink chamber 15-5 are deformed so as to decrease a volume of the ink chamber 15-4 which communicates with the assistance related nozzle No. 4. Due to this deformation, pressure vibration in the ink chambers 15-1 and 15-7 is absorbed.

In the section from t9 to t10, the potential codes of the ejection both-adjacent waveform setting register 403 and the assistance both-adjacent waveform setting register 411 are changed to "00". For this reason, in the logic circuit 300, the ground signal Gx is generated as the control signals No.0SW, No.2SW, No.3SW, No.5SW, No.6SW and No.8SW and is output to the switch circuit 200. In the switch circuit 200, the ground contact points [G] of the control switches SW0, SW2, SW3, SW5, SW6 and SW8 are turned on by the control signals No.0SW, No.2SW, No.3SW, No.5SW, No.6SW and No.8SW. As a result, potentials of the electrodes 4 of the ink chambers 15-0, 15-2, 15-3, 15-5, 15-6 and 15-8 become the ground voltage VSS.

In the section from t10 to t11, both of the potential codes of the ejection related waveform setting register 401 and the assistance related waveform setting register 409 are changed to "00". For this reason, in the logic circuit 300, the ground signal Gx is generated as the control signals No.1SW, No.4SW and No.7SW and is output to the switch circuit 200. In the switch circuit 200, the ground contact points [G] of the control switches SW1, SW4 and SW7 are turned on by the control signals No.1SW, No.4SW and No.7SW. As a result, potentials of the electrodes 4 of the ink chambers 15-1, 15-4 and 15-7 become the ground voltage VSS.

Accordingly, potentials of the electrodes 4 of the respective ink chambers 15-0 to 15-8 all become the ground voltage VSS. In other words, the head 100 returns to a normal state.

Figure 16:
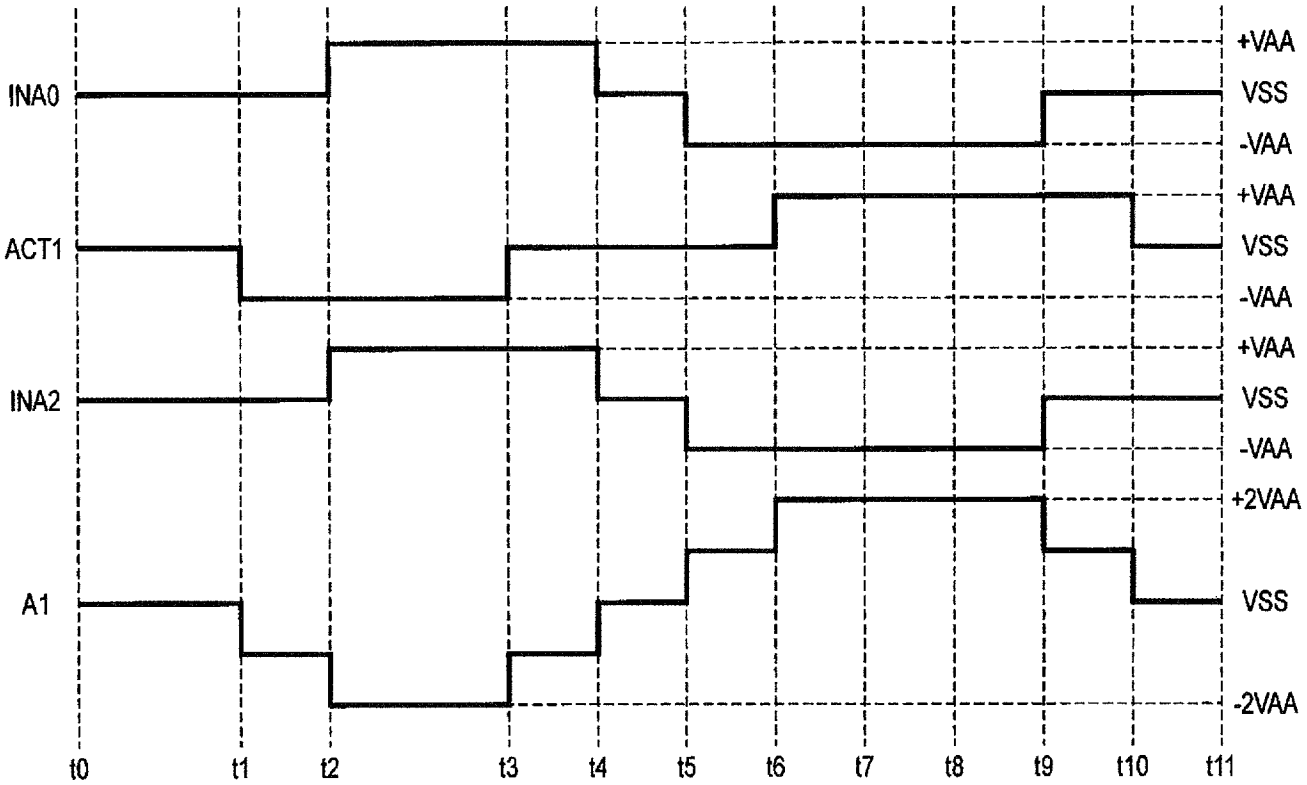
FIG. 16 is a timing diagram of driving pulses generated from the coding scheme.

In the above-described sections from t0 to t11, a driving pulse voltage applied to the electrode of the ink chamber 15-0 which communicates with the ejection both-adjacent nozzle 8-0 has a waveform INA0 of FIG. 16. A driving pulse voltage applied to the electrode of the ink chamber 15-1 which communicates with the ejection related nozzle 8-1 has a waveform ACT1 of FIG. 16. A driving pulse voltage applied to the electrode of the ink chamber 15-2 which communicates with the ejection both-adjacent nozzle 8-2 has a waveform INA2 of FIG. 16. A driving pulse voltage acting on the electrode of the ink chamber 15-1 which communicates with the ejection related nozzle 8-1 has a waveform A1 of FIG. 16.

Figure 17:
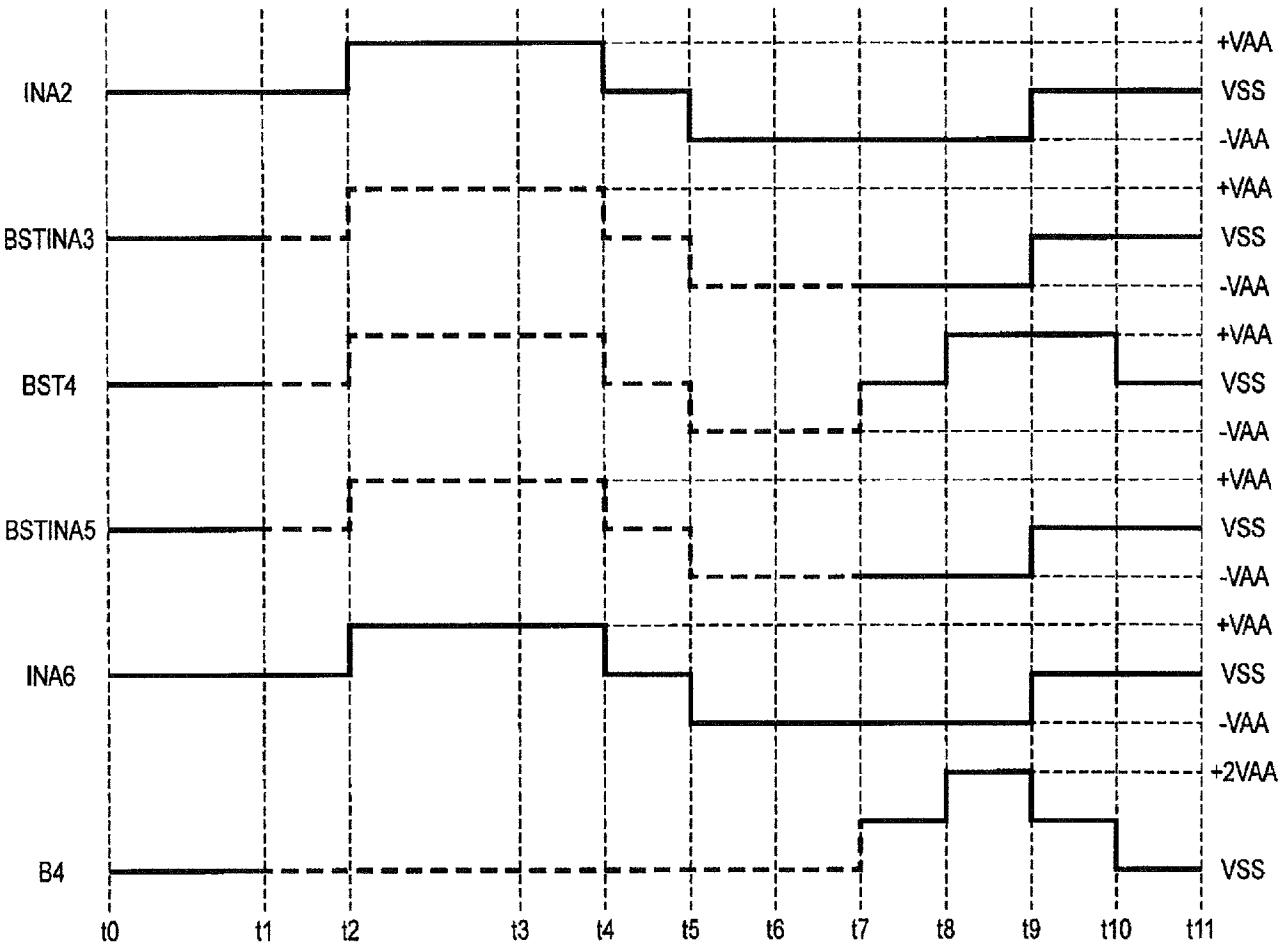
FIG. 17 is a timing diagram of driving pulses generated from the coding scheme.

In addition, in the sections from t0 to t11, a driving pulse voltage applied to the electrode of the ink chamber 15-2 which communicates with the ejection both-adjacent nozzle 8-2 has a waveform INA2 of FIG. 17. A driving pulse voltage applied to the electrode of the ink chamber 15-3 which communicates with the assistance both-adjacent nozzle 8-3 has a waveform BSTINA3 of FIG. 17. A driving pulse voltage applied to the electrode of the ink chamber 15-4 which communicates with the assistance related nozzle 8-4 has a waveform BST4 of FIG. 17. A driving pulse voltage applied to the electrode of the ink chamber 15-5 which communicates with the assistance both-adjacent nozzle 8-5 has a waveform BSTINA5 of FIG. 17. A driving pulse voltage applied to the electrode of the ink chamber 15-6 which communicates with the ejection both-adjacent nozzle 8-6 has a waveform INA6 of FIG. 17. Further, in FIG. 17, the broken lines indicate that the electrodes 4 are controlled to have a high impedance state.

As illustrated in FIG. 17, in the sections from t1 to t7, the voltages with the same potential are simultaneously applied to the electrodes 4 of the ink chambers 15-2 and 15-6. On the other hand, the electrodes 4 of the ink chambers 15-3, 15-4 and 15-5 are controlled to have a high impedance state in the sections from t1 to t7. For this reason, the electrodes 4 of the ink chambers 15-3, 15-4 and 15-5 are induced to have a voltage applied to the ink chambers 15-2 and 15-6 on both side thereof, and undergo the same variation. As a result, a driving pulse voltage acting on the electrode of the ink chamber 15-4 which communicates with the assistance related nozzle 8-4 has a waveform B4 of FIG. 17.

During that time, a driving pulse voltage is not applied to the electrodes 4 of the ink chamber 15-3 to the ink chamber 15-5. For this reason, a floating capacitor is not charged or discharged in the ink chambers 15-3 to 15-5. Therefore, noise current or wasteful power consumption which is caused by simultaneously applying voltages with the same potential to the electrodes 4 of a plurality of ink chambers 15-3 to 15-5 which are arranged in parallel can be reliably removed.

Second Exemplary Embodiment

Figure 18:
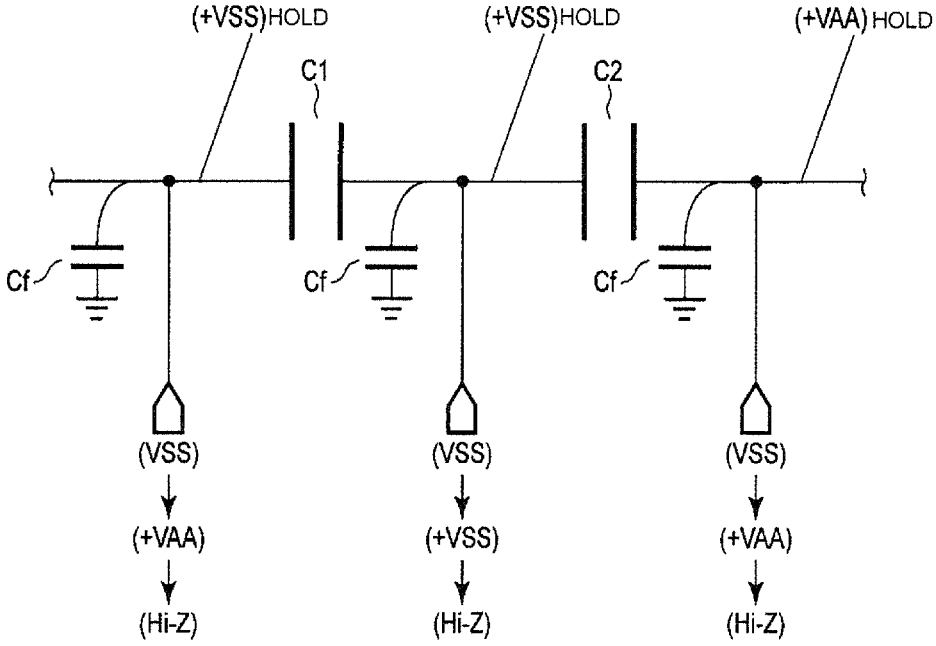
FIG. 18 is a circuit diagram illustrating a physical property of a capacitor used in a second exemplary embodiment.

In the first exemplary embodiment, the physical property of a capacitor described referring to FIG. 7 is used to reduce noise current or wasteful power consumption caused by a floating capacitor. In the second exemplary embodiment, a physical property of a capacitor described referring to FIG. 18 is used to reduce noise current or wasteful power consumption caused by a floating capacitor. In addition, a part common to the first exemplary embodiment is given the same reference numeral, and detailed description thereof will be omitted.

FIG. 18 illustrates a series circuit of capacitors C1 and C2, which is an equivalent circuit of the head 100. In addition, in FIG. 18, the reference sign Cf indicates a floating capacitor. In this series circuit, if a potential difference is given to each of the capacitor C1 and the capacitor C2, and then both ends of each of the capacitor C1 and the capacitor C2 are set to a high impedance state, each of the capacitors C1 and C2 holds the previous potential difference. In other words, if the capacitors C1 and C2 are turned to a high impedance state in a state in which a potential difference is given thereto, the capacitors C1 and C2 have a physical property of holding the previous potential difference.

Therefore, the driving device sets the electrodes 4 which are disposed with the partition 16-($i$−1)i interposed therebetween to a high impedance state, in a state in which a potential difference is given to the partition 16-($i$−1)i which separates the ink chambers 15-($i$−1) and 15-$i$ arranged in parallel from each other. Also in this case, the potential difference of the partition 16-($i$−1)i is held, and thus an ink ejection operation is not obstructed. The electrode 4 is set to a high impedance state, and thus a driving pulse voltage can temporarily stop being applied to the electrode 4. Therefore, noise current or wasteful power consumption caused by a floating capacitor can be suppressed.

In the second exemplary embodiment, the driving device of the first exemplary embodiment can also be employed just by changing codes set in the register group of the pattern generator 400.

Figure 19:
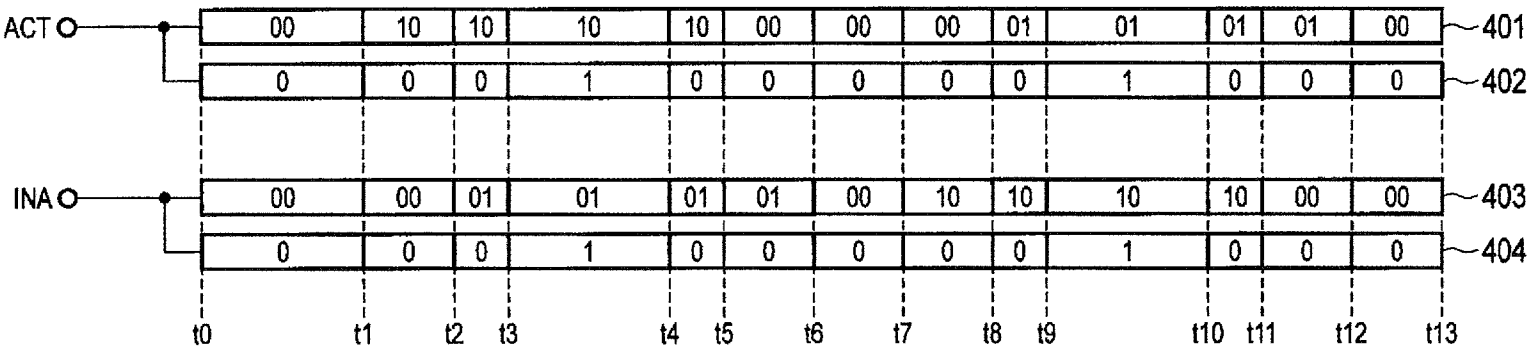
FIG. 19 is a schematic diagram illustrating an example of potential codes which are set in an ejection related waveform setting register and an ejection both-adjacent waveform setting register and Hi-Z designation codes which are set in Hi-Z setting registers in the second exemplary embodiment.

FIG. 19 illustrates an example of potential codes which are set in the ejection related waveform setting register 401 and the ejection both-adjacent waveform setting register 403 and Hi-Z designation codes which are set in Hi-Z setting registers 402 and 404 which respectively correspond to the registers in the second exemplary embodiment. This example corresponds to the driving pulse voltage patterns of FIG. 5.

In FIG. 19, a section from the time point t0 to the time point t1 corresponds to the normal state. A section from the time point t1 to the time point t6 corresponds to the drawing state. A section from the time point t6 to the time point t7 corresponds to the normal state following the drawing state. A section from the time point t7 to the time point t12 corresponds to the compression state. A section from the time point t12 to the time point t13 corresponds to the normal state following the compression state.

In the section from t0 to t1, a potential code of the ejection related waveform setting register 401 is "00", and a Hi-Z designation code of the Hi-Z setting register 402 is "0". In addition, a potential code of the ejection both-adjacent waveform setting register 403 is "00", and a Hi-Z designation code of the Hi-Z setting register 404 is also "0". For this reason, the ground signal Gx is generated as the control signals No.1SW, No.0SW and No.2SW for the ejection related nozzle 8-1 and the ejection both-adjacent nozzles 8-0 and 8-2 and is output to the switch circuit 200 in the logic circuit 300. In the switch circuit 200, the ground contact points [G] of the control switches SW1, SW0 and SW2 are turned on by the control signals No.1SW, No.0SW and No.2SW. As a result, potentials of the electrode 4 of the ink chamber 15-1 which communicates with the ejection related nozzle 8-1 and the electrodes 4 of the ink chambers 15-0 and 15-2 which communicate with the ejection both-adjacent nozzles 8-0 and 8-2 all become the ground voltage VSS.

In the section from t1 to t2, the potential code of the ejection related waveform setting register 401 is changed to "10". For this reason, in the logic circuit 300, the negative voltage pulse signal MVx is generated as the control signal No.1SW and is output to the switch circuit 200. In the switch circuit 200, the negative voltage contact point [−] of the control switch SW1 is turned on by the control signal No.1SW. As a result, a potential of the electrode 4 of the ink chamber 15-1 becomes the negative voltage −VAA.

In the section from t2 to t3, the potential code of the ejection both-adjacent waveform setting register 403 is changed to "01". For this reason, in the logic circuit 300, the positive voltage pulse signal PVx is generated as the control signals No.0SW and No.2SW and is output to the switch circuit 200. In the switch circuit 200, the positive voltage contact points [+] of the control switches SW0 and SW2 are turned on by the control signals No.0SW and No.2SW. As a result, potentials of the electrodes 4 of the ink chambers 15-0 and 15-2 become the positive voltage +VAA.

Accordingly, there is the occurrence of a potential difference between the partitions 16-01 and 16-12 which are respectively located between the ink chamber 15-0 and the ink chamber 15-1 and between the ink chamber 15-1 and the ink chamber 15-2. Due to this potential difference, the partitions 16-01 and 16-12 are deformed so as to increase a volume of the ink chamber 15-1 which communicates with the ejection related nozzle No. 1.

In the section from t3 to t4, both of the Hi-Z designation codes of the Hi-Z setting register 402 corresponding to the ejection related waveform setting register 401 and the Hi-Z setting register 404 corresponding to the ejection both-adjacent waveform setting register 403 are changed to "1". For this reason, in the logic circuit 300, the high impedance control signals are generated as the control signals No.0SW, No.1SW and No.2SW, and are output to the switch circuit 200. In the switch circuit 200, the control switches SW0, SW1 and SW2 are turned off by the high impedance control signals. As a result, the respective electrodes 4 of the ink chambers 15-0, 15-1 and 15-2 are turned to a high impedance state.

However, since the electrodes 4 of the respective ink chambers 15-0, 15-1 and 15-2 are turned to a high impedance state, in a state in which the potential difference is given, the previous potential difference is held. In other words, the electrode 4 of the ink chamber 15-1 holds the negative voltage −VAA, and the electrodes of the ink chambers 15-0 and 15-2 hold the positive voltage +VAA.

In the section from t4 to t5, both of the Hi-Z designation codes of the Hi-Z setting register 402 and the Hi-Z setting register 404 are changed to "0". For this reason, in the logic circuit 300, the negative voltage pulse signal MVx is generated as the control signal No.1SW and is output to the switch circuit 200. In addition, in the logic circuit 300, the positive voltage pulse signal PVx is generated as the control signals No.0SW and No.2SW and is output to the switch circuit 200. In the switch circuit 200, the negative voltage contact point [−] of the control switch SW1 is turned on by the control signal No.1SW. However, the electrode 4 of the ink chamber 15-1 holds the negative voltage −VAA, and thus a potential thereof does not vary. Further, in the switch circuit 200, the positive voltage contact points [+] of the control switches SW0 and SW2 are also turned on by the control signals No.0SW and No.2SW. However, the electrodes 4 of the ink chambers 15-0 and 15-2 hold the positive voltage +VAA, and thus potentials thereof also do not vary.

In the section from t5 to t6, the potential code of the ejection related waveform setting register 401 is changed to "00". For this reason, in the logic circuit 300, the ground signal Gx is generated as the control signal No.1SW and is output to the switch circuit 200. In the switch circuit 200, the ground contact point [G] of the control switch SW1 is turned on by the control signal No.1SW. As a result, a potential of the electrode 4 of the ink chamber 15-1 becomes the ground voltage VSS.

In the section from t6 to t7, the potential code of the ejection both-adjacent waveform setting register 403 is changed to "00". For this reason, in the logic circuit 300, the ground signal Gx is generated as the control signals No.0SW and No.2SW and is output to the switch circuit 200. In the switch circuit 200, the ground contact points [G] of the control switches SW0 and SW2 are turned on by the control signals No.0SW and No.2SW. As a result, potentials of the electrodes 4 of the ink chambers 15-0 and 15-2 become the ground voltage VSS.

Accordingly, there is no occurrence of a potential difference between the partitions 16-01 and 16-12 which are respectively located between the ink chamber 15-0 and the ink chamber 15-1 and between the ink chamber 15-1 and the ink chamber 15-2. In other words, the head 100 is returned to a normal state.

In the section from t7 to t8, the potential code of the ejection both-adjacent waveform setting register 403 is changed to "10". For this reason, in the logic circuit 300, the negative voltage pulse signal MVx is generated as the control signals No.0SW and No.2SW and is output to the switch circuit 200. In the switch circuit 200, the negative voltage contact points [−] of the control switches SW0 and SW2 are turned on by the control signals No.0SW and No.2SW. As a result, potentials of the electrodes 4 of the ink chambers 15-0 and 15-2 become the negative voltage −VAA.

In the section from t8 to t9, the potential code of the ejection related waveform setting register 401 is changed to "01". For this reason, in the logic circuit 300, the positive voltage pulse signal PVx is generated as the control signal No.1SW and is output to the switch circuit 200. In the switch circuit 200, the positive voltage contact point [+] of the control switch SW1 is turned on by the control signal No.1SW. As a result, a potential of the electrode 4 of the ink chamber 15-1 becomes the positive voltage +VAA.

Accordingly, there is the occurrence of a potential difference between the partitions 16-01 and 16-12 which are respectively located between the ink chamber 15-0 and the ink chamber 15-1 and between the ink chamber 15-1 and the ink chamber 15-2. As a result, the partitions 16-01 and 16-12 are deformed so as to decrease a volume of the ink chamber 15-1 which communicates with the ejection related nozzle No. 1.

In the section from t9 to t10, both of the Hi-Z designation codes of the Hi-Z setting register 402 corresponding to the ejection related waveform setting register 401 and the Hi-Z setting register 404 corresponding to the ejection both-adjacent waveform setting register 403 are changed to "1". For this reason, in the logic circuit 300, the high impedance control signals are generated as the control signals No.0SW, No.1SW and No.2SW, and are output to the switch circuit 200. In the switch circuit 200, the control switches SW0, SW1 and SW2 are turned off by the high impedance control signals. As a result, the respective electrodes 4 of the ink chambers 15-0, 15-1 and 15-2 are turned to a high impedance state.

However, since the electrodes 4 of the respective ink chambers 15-0, 15-1 and 15-2 are turned to a high impedance state, in a state in which the potential difference is given, the previous potential difference is held. In other words, the electrode 4 of the ink chamber 15-1 holds the positive voltage +VAA, and the electrodes of the ink chambers 15-0 and 15-2 hold the negative voltage −VAA.

In the section from t10 to t11, both of the Hi-Z designation codes of the Hi-Z setting register 402 and the Hi-Z setting register 404 are changed to "0". For this reason, in the logic circuit 300, the positive voltage pulse signal PVx is generated as the control signal No.1SW and is output to the switch circuit 200. In addition, in the logic circuit 300, the negative voltage pulse signal MVx is generated as the control signals No.0SW and No.2SW and is output to the switch circuit 200. In the switch circuit 200, the positive voltage contact point [+] of the control switch SW1 is turned on by the control signal No.1SW. However, the electrode 4 of the ink chamber 15-1 holds the positive voltage +VAA, and thus a potential thereof does not vary. Further, in the switch circuit 200, the negative voltage contact points [−] of the control switches SW0 and SW2 are also turned on by the control signals No.0SW and No.2SW. However, the electrodes 4 of the ink chambers 15-0 and 15-2 hold the negative voltage −VAA, and thus potentials thereof also do not vary.

In the section from t11 to t12, the potential code of the ejection both-adjacent waveform setting register 403 is changed to "00". For this reason, in the logic circuit 300, the ground signal Gx is generated as the control signals No.0SW and No.2SW and is output to the switch circuit 200. In the switch circuit 200, the ground contact points [G] of the control switches SW0 and SW2 are turned on by the control signals No.0SW and No.2SW. As a result, potentials of the electrodes 4 of the ink chambers 15-0 and 15-2 become the ground voltage VSS.

In the section from t12 to t13, the potential code of the ejection related waveform setting register 401 is changed to "00". For this reason, in the logic circuit 300, the ground signal Gx is generated as the control signal No.1SW and is output to the switch circuit 200. In the switch circuit 200, the ground contact point [G] of the control switch SW1 is turned on by the control signal No.1SW. As a result, a potential of the electrode 4 of the ink chamber 15-1 becomes the ground voltage VSS.

Accordingly, there is no occurrence of a potential difference between the partitions 16-01 and 16-12 which are respectively located between the ink chamber 15-0 and the ink chamber 15-1 and between the ink chamber 15-1 and the ink chamber 15-2. In other words, the head 100 is returned to a normal state.

Figure 20:
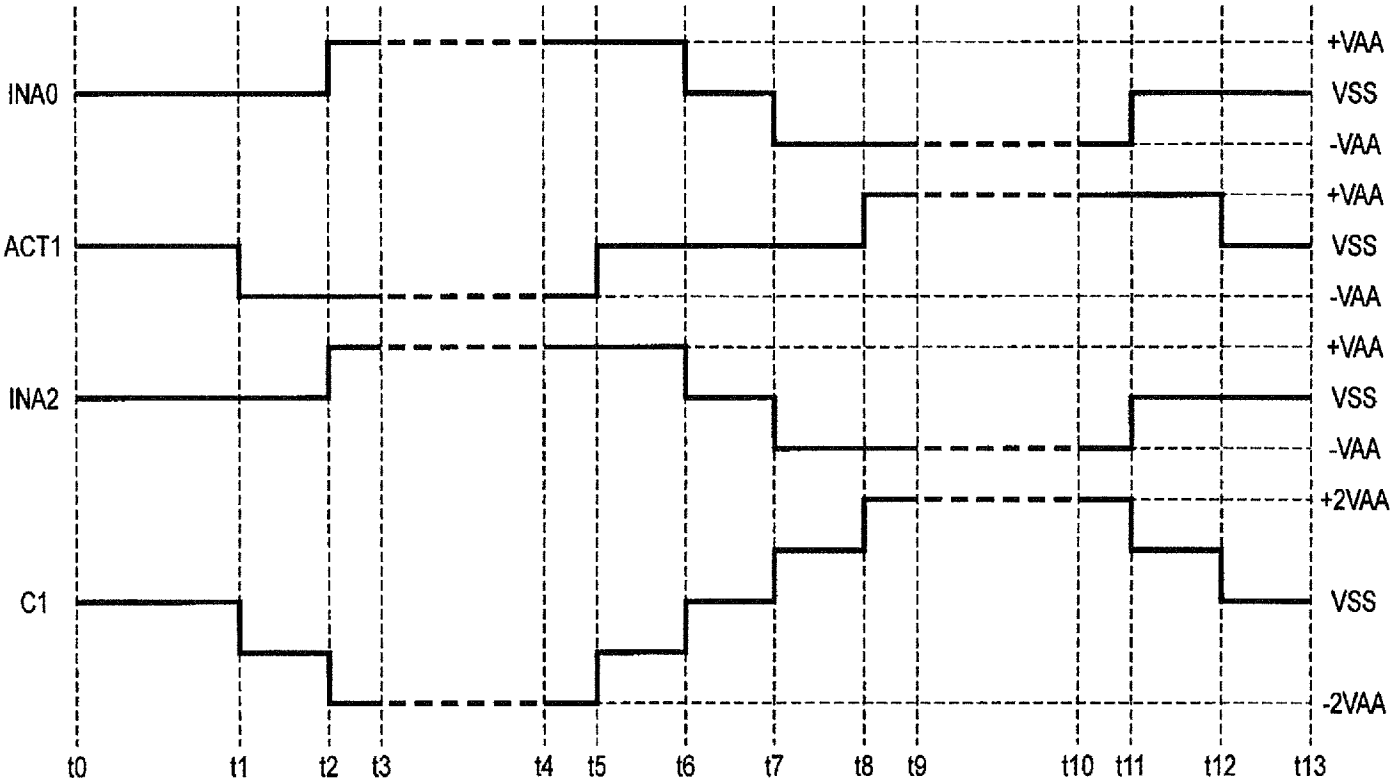
FIG. 20 is a timing diagram of driving pulses generated from the coding scheme.

In the above-described sections from t0 to t13, a driving pulse voltage applied to the electrode of the ink chamber 15-0 which communicates with the ejection both-adjacent nozzle 8-0 has a waveform INA0 of FIG. 20. A driving pulse voltage applied to the electrode of the ink chamber 15-1 which communicates with the ejection related nozzle 8-1 has a waveform ACT1 of FIG. 20. A driving pulse voltage applied to the electrode of the ink chamber 15-2 which communicates with the ejection both-adjacent nozzle 8-2 has a waveform INA2 of FIG. 20. A driving pulse voltage acting on the electrode of the ink chamber 15-1 which communicates with the ejection related nozzle 8-1 has a waveform C1 of FIG. 20. In addition, in FIG. 20, the broken lines indicate that the electrodes 4 are controlled to have a high impedance state.

As illustrated in FIG. 20, in the section from t3 to t4, the electrodes 4 disposed on both sides of the partition 16-01 which separates the ink chamber 15-0 from the ink chamber 15-1 and the electrodes 4 disposed on both sides of the partition 16-12 which separates the ink chamber 15-1 from the ink chamber 15-2 are all turned to a high impedance state. At this time, the electrodes 4 hold the previous potential differences. In other words, the electrodes 4 of the ink chamber 15-0 and the ink chamber 15-2 hold the positive voltage +VAA, and the electrode 4 of the ink chamber 15-1 holds the negative voltage −VAA. Therefore, the partition 16-01 and the partition 16-12 hold a deformed state in a direction in which a volume of the ink chamber 15-1 increases.

Similarly, also in the section from t9 to t10, the electrodes 4 disposed on both sides of the partition 16-01 and the electrodes 4 disposed on both sides of the partition 16-12 are all turned to a high impedance state. At this time, the electrodes 4 hold the previous potential differences. In other words, the electrodes 4 of the ink chamber 15-0 and the ink chamber 15-2 hold the negative voltage −VAA, and the electrode 4 of the ink chamber 15-1 holds the positive voltage +VAA. Therefore, the partition 16-01 and the partition 16-12 hold a deformed state in a direction in which a volume of the ink chamber 15-1 decreases.

As above, even if the electrode 4 is temporarily in a high impedance state, there is no influence on an ink ejection operation. Since a driving pulse voltage is not applied to the electrode 4 in a high impedance state, a floating capacitor is not charged or discharged in the ink chambers 15-3 to 15-5 while the electrode 4 is in a high impedance state. Therefore, also in the present exemplary embodiment, noise current or wasteful power consumption which is caused by simultaneously applying voltages with the same potential to the electrodes 4 of a plurality of ink chambers 15-3 to 15-5 which are arranged in parallel can be reliably removed.

Third Exemplary Embodiment

The third exemplary embodiment will be described with reference to FIG. 21.

Figure 21:
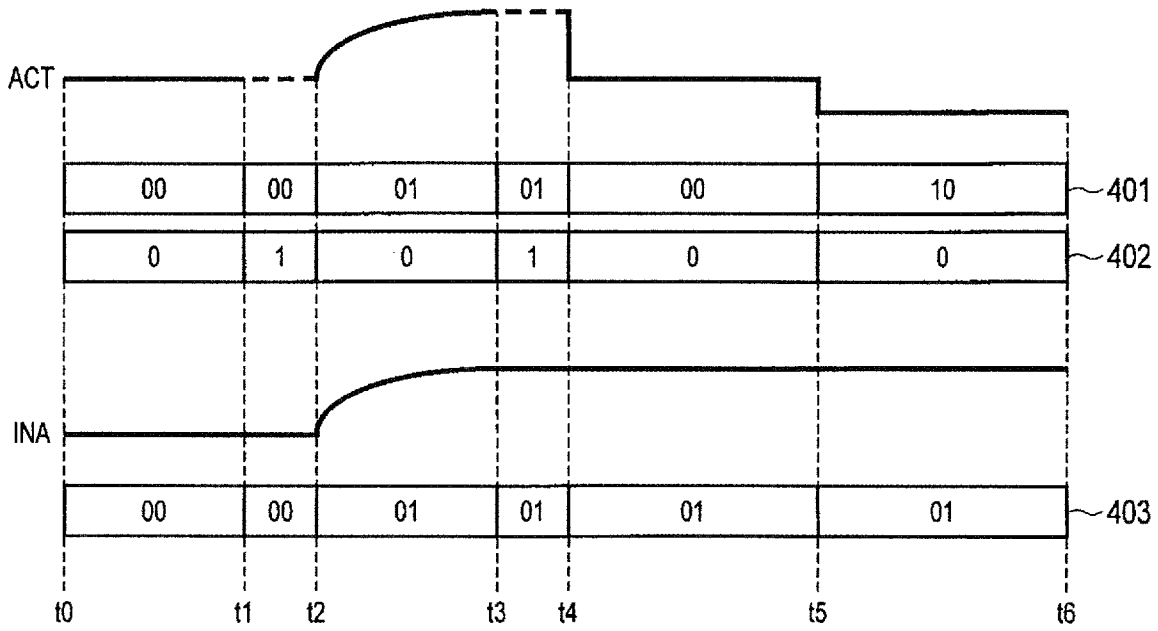
FIG. 21 is a schematic diagram illustrating an example of a coding scheme which is set in main registers of a register group forming the pattern generator, and a timing diagram of driving pulses generated from the coding scheme, in a third exemplary embodiment.

In FIG. 21, a signal waveform ACT is an example of driving pulses applied to the electrode of the ink chamber 15 which communicates with an ejection related nozzle. A signal waveform INA is an example of driving pulses applied to the electrodes of the ink chambers 15 which communicate with ejection both-adjacent nozzles. In addition, FIG. 21 illustrates potential codes which are respectively set in the ejection related waveform setting register 401 and the ejection both-adjacent waveform setting register 403 and Hi-Z designation codes set in the Hi-Z setting register 402 corresponding to the ejection related waveform setting register 401, so as to correspond to the examples.

As illustrated in FIG. 21, the signal waveform ACT and the signal waveform INA simultaneously perform switching at the time point t2 and the time point t4. Therefore, in the present exemplary embodiment, the Hi-Z designation codes are set so that the electrode 4 of the ink chamber 15 which communicates with the ejection related nozzle is turned to a high impedance state at the previous time points t1 and t3 to the time points t2 and t4 of simultaneously performing switching.

In this way, the electrode 4 of the ink chamber 15 which communicates with the ejection related nozzle is turned to a high impedance state along with the ejection both-adjacent nozzles immediately before simultaneous switching is performed. The electrode 4 holds the previous potential even in a high impedance state, and thus an ink ejection operation is not obstructed.

As above, the electrode 4 of the ink chamber 15 which communicates with the ejection related nozzle is turned to a high impedance state immediately before simultaneous switching is performed, and thus noise of peak current caused by the simultaneous switching can be reduced.

In addition, in the third exemplary embodiment, the electrode 4 of the ink chamber 15 which communicates with the ejection related nozzle is turned to a high impedance state immediately before simultaneous switching is performed, but the same operation and effect can be achieved even if the electrodes 4 of the ink chambers 15 which communicate with the ejection both-adjacent nozzles are turned to a high impedance state.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A driving device of an inkjet head in which electrodes are respectively disposed on wall surfaces of a plurality of ink chambers which are arranged in parallel so as to be separated from each other by partitions made of a piezoelectric material, a potential difference is given to the electrodes of two adjacent ink chambers so as to deform the partitions interposed between the electrodes, and ink is ejected from a nozzle which communicates with the ink chamber having the deformable partitions as wall surfaces, the device comprising:

a controller that sets the electrodes to a high impedance state, wherein, at a timing when an identical potential is applied to the electrodes of at least three adjacent ink chambers which are arranged in parallel so as to be separated from each other by mutually adjacent partitions, the controller sets electrodes of middle ink chambers other than ink chambers located on both sides of the middle ink chambers to a high impedance state.

2. The device according to claim 1, wherein, when the ink chambers other than the ink chambers located on both sides of the middle ink chambers include an ink chamber which performs assistance driving without ejecting ink, the controller applies the identical potential to an electrode of the ink chamber which performs the assistance driving.

3. A driving device of an inkjet head in which electrodes are respectively disposed on wall surfaces of a plurality of ink chambers which are arranged in parallel so as to be separated from each other by partitions made of a piezoelectric material, a potential difference is given to the electrodes of two adjacent ink chambers so as to deform the partitions interposed between the electrodes, and ink is ejected from a nozzle which communicates with the ink chamber having the deformed deformable partitions as wall surfaces, the device comprising:

a controller that sets the electrodes to a high impedance state, wherein, when a potential difference is given to the electrodes of the two adjacent ink chambers, the controller temporarily sets the electrodes to a high impedance state in a section in which the potential difference is held.

4. A driving device of an inkjet head in which electrodes are respectively disposed on wall surfaces of a plurality of ink chambers which are arranged in parallel so as to be separated from each other by partitions made of a piezoelectric material, a potential difference is given to the electrodes of two adjacent ink chambers so as to deform the partitions interposed between the electrodes, and ink is ejected from a nozzle which communicates with the ink chamber having the deformable partitions as wall surfaces, the device comprising:

a controller that sets the electrodes to a high impedance state, wherein, when the two adjacent ink chambers simultaneously perform switching, the controller sets the electrode of at least one ink chamber to a high impedance state immediately before the switching is performed.

* * * * *